US006016109A

United States Patent [19]

Yosida et al.

[11] Patent Number: 6,016,109

[45] Date of Patent: Jan. 18, 2000

[54] MOBILE UNIT SUPPORT SYSTEM

[75] Inventors: Takasi Yosida, Ikoma; Joji Kane, Nara; Noboru Nomura, Kyoto, all of Japan

[73] Assignee: Matsushita Electric Industrial Co., Ltd., Osaka, Japan

[21] Appl. No.: 09/049,998

[22] Filed: Mar. 30, 1998

[30] Foreign Application Priority Data

Mar. 28, 1997 [JP] Japan ..... 9-077013

[51] Int. Cl.[7] ..... G08G 1/01

[52] U.S. Cl. ..... 340/941; 340/905; 340/933

[58] Field of Search ..... 340/941, 933, 340/935, 854.6, 854.8, 936, 939, 905

[56] References Cited

U.S. PATENT DOCUMENTS

| | | | |
|---|---|---|---|
| 3,839,700 | 10/1974 | DeLorenzo et al. | 340/941 |
| 3,976,970 | 8/1976 | Tuffet et al. | 340/905 |
| 4,487,385 | 12/1984 | Salmon | 340/941 |
| 4,920,340 | 4/1990 | Mizuno | 340/941 |
| 4,968,979 | 11/1990 | Mizuno et al. | 340/941 |
| 5,491,475 | 2/1996 | Rouse et al. | 340/933 |

OTHER PUBLICATIONS

"Magnetic Sensing of Running Car," pp. 83–92, Daigo Kato, et al., *MAG–96–94,* Nagoya University.

"Colpitts–Oscillator–Type Micro–Magnetic Sensor Using Amorphous MI Elements," T. Uchiyama, et al., *EI,* vol. 19, No. 2, 1995, Nagoya University.

*Primary Examiner*—Jeffery A. Hofsass
*Assistant Examiner*—Van T. Trieu
*Attorney, Agent, or Firm*—Smith, Gambrell & Russell, LLP

[57] ABSTRACT

A mobile unit support system comprises at least one magnetic member for forming a magnetic field in said vicinity of a movement path of a mobile unit which is made of a dielectromagnetic material; and at least one magnetic sensor which, when said mobile unit passes over, detects a change of said magnetic field and which transmits a result of said detection to an external, and said mobile unit comprises receiving means for receiving said transmitted signal, and a processing section which processes a signal from said receiving means.

4 Claims, 19 Drawing Sheets

Fig. 6(a)
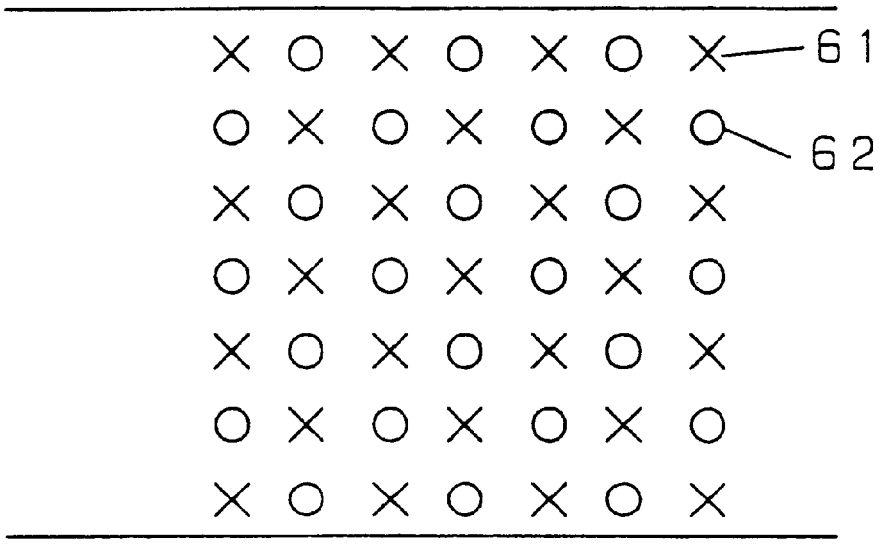
Fig. 6(b)
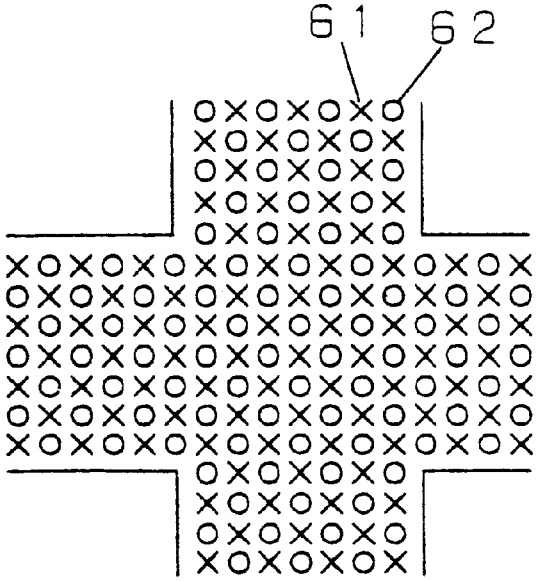
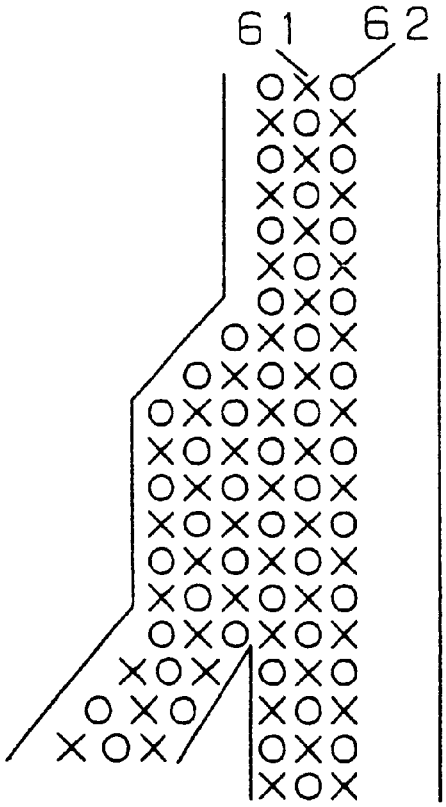
Fig. 6(c)

MOBILE UNIT SUPPORT SYSTEM

BACKGROUND OF THE INVENTION

1. Field of the Invention

The invention relates to a mobile unit support system which supports movement of a mobile unit by detecting movement information of the mobile unit using a magnetic sensor, and by sending the information to an appropriate processing system, which may be included with the mobile unit.

2. Art Relating to the Invention

In modern life, an automobile is indispensable for moving human beings and goods. On the other hand, problems arise in that traffic accidents are increased, and that smooth traffic movement is impeded by traffic jams or the like.

Recently, attempts have been made to manage movement of automobiles so that the automobiles move more safely and efficiently. In order to realize such management, it is necessary to obtain detailed information relating to the movement of each automobile and to appropriately supply this information to the automobiles or their operators.

For example, a system has been studied in which plural magnetic nails, each having a magnetic member, are embedded in a road surface, and an automobile having a magnetic sensor is moved under the guidance of these magnetic nails.

In such a prior art system, however, the sensitivity of the detection of a magnetic field formed by the magnetic nails that are embedded in a road and have a magnetic member is so low that it is not sufficient for automatically controlling an automobile. The function of such a system is restricted to a single function, such as detection of the existence of another mobile unit or guidance along a path. In order to realize such a system, however, all mobile units must be provided with a magnetic sensor. Therefore, it is difficult to construct a system in which automobiles having a magnetic sensor and those not having a magnetic sensor can coexist. In order to control an automobile in a highly safe manner, the automobile must obtain traffic information of a wide range, through a certain wireless channel, such as radio wave or light.

SUMMARY OF THE INVENTION

In view of these problems of the prior art, it is an object of the invention to provide a mobile unit support system which detects movement information of a mobile unit with high sensitivity, transmits the movement information to the outside, centrally processes and manages the information, and resends the information to the mobile unit, whereby movement of the mobile unit is highly supported.

A mobile unit support system of the present invention includes: at least one magnetic member for forming a magnetic field in the vicinity of a movement path of a mobile unit, wherein the mobile unit is made of a dielectromagnetic material; and at least one magnetic sensor which, when the mobile unit passes over it, detects a change of the magnetic field and transmits a result of the detection to an external processing system. The mobile unit comprises receiving means for receiving the transmitted signal and a processing section which processes a signal received from the receiving means.

Another mobile unit support system of the present invention includes at least one magnetic sensor which is disposed in the vicinity of a movement path of a mobile unit, wherein the mobile unit is made of a dielectromagnetic material or has at least one magnetic member. When the mobile unit passes over the sensor, the sensor detects a change of a magnetic field and transmits a result of the detection to an external processing system. The mobile unit comprises receiving means for receiving the transmitted signal and a processing section which processes a signal received from the receiving means.

Another mobile unit support system of the present invention includes a system located in the vicinity of a movement path of a mobile unit, wherein the mobile unit is made of a dielectromagnetic material. This system includes at least one magnetic member and at least one magnetic sensor. When the mobile unit passes over the system, the system detects a change of a magnetic field formed by the magnetic member and a member which is made of a dielectromagnetic material and which has a flat shape or a bent shape and is embedded in the ground on a side opposite to the movement path with respect to the magnetic member and the magnetic sensor.

Another mobile unit support system of the present invention includes at least one magnetic member for forming a magnetic field disposed in the vicinity of a movement path of a mobile unit (wherein the mobile unit is made of a dielectromagnetic material), plural magnetic sensors disposed at predetermined intervals along a movement direction of the mobile unit, and at least one centralized processing device.

In this support system, each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system.

Additionally, in this system, the centralized processing device receives signals from the transmitting means of the plural magnetic sensors and processes the signals to obtain at least one of: (a) a movement direction, (b) a position, (c) a speed, (d) a length of the mobile unit, and (e) a distance between mobile units, and then manages movement information of the mobile unit.

Another mobile unit support system of the present invention includes at least one magnetic member for forming a magnetic field disposed in the vicinity of a movement path of a mobile unit (wherein the mobile unit is made of a dielectromagnetic material), and plural magnetic sensors disposed at predetermined intervals along a movement direction of the mobile unit, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the mobile unit comprises: receiving means for receiving a signal from the transmitting means; and a processing section which: (a) processes a signal from the receiving means and informs a driver of the mobile unit of information obtained by processing the signal from the receiving means or (b) processes the signal from the receiving means and performs a movement control on the basis of the processing.

Another mobile unit support system of the present invention includes at least one magnetic member for forming a magnetic field disposed in the vicinity of a movement path of a mobile unit (wherein the mobile unit is made of a dielectromagnetic material), plural magnetic sensors disposed at predetermined intervals along a line which is substantially perpendicular to a movement direction of the mobile unit, and at least one centralized processing device, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the centralized processing device receives signals from the transmitting means of the plural magnetic sensors and processes the signals to obtain one of: (a) deviation of the mobile unit in the movement path and (b) a distance between mobile units, and then manages movement information of the mobile unit.

Another mobile unit support system of the present invention includes at least one magnetic member for forming a magnetic field disposed in the vicinity of a movement path of a mobile unit (wherein the mobile unit is made of a dielectromagnetic material), and plural magnetic sensors disposed at predetermined intervals along a line which is substantially perpendicular to a movement direction of the mobile unit, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the mobile unit comprises: receiving means for receiving a signal from the transmitting means; and a processing section which: (a) processes a signal from the receiving means and informs a driver of the mobile unit of information obtained by processing the signal from the receiving means or (b) processes the signal from the receiving means and performs a movement control on the basis of the processing.

Another mobile unit support system of the present invention includes at least one magnetic member for forming a magnetic field disposed in the vicinity of a movement path of a mobile unit (wherein the mobile unit is made of a dielectromagnetic material), plural magnetic sensors disposed at predetermined intervals in a plane of the movement path, and at least one centralized processing device, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the centralized processing device receives signals from the transmitting means of the plural magnetic sensors and processes the signals to obtain in more detail at least one of: (a) a position in the plane of the movement path, (b) a movement direction, (c) a speed, (d) a length of the mobile unit, and (e) a distance between mobile units, and then manages movement of the mobile unit.

Another mobile unit support system of the present invention includes, in the vicinity of a movement path of a mobile unit (wherein the mobile unit is made of a magnetic member or has at least one magnetic member), plural magnetic sensors disposed at predetermined intervals along a movement direction of the mobile unit, and at least one centralized processing device, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the centralized processing device receives signals from the transmitting means of the plural magnetic sensors and processes the signals to obtain at least one of: (a) a movement direction, (b) a position, (c) a speed, (d) a length of the mobile unit, and (e) a distance between mobile units, and then manages movement of the mobile unit.

Another mobile unit support system of the present invention includes, in the vicinity of a movement path of a mobile unit (wherein the mobile unit is made of a magnetic member or has at least one magnetic member), plural magnetic sensors disposed at predetermined intervals along a movement direction of the mobile unit, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the mobile unit comprises: receiving means for receiving a signal from the transmitting means; and a processing section which: (a) processes a signal from the receiving means and informs a driver of the mobile unit of information obtained by processing the signal from the receiving means or (b) processes the signal from the receiving means and performs a movement control on the basis of the processing.

Another mobile unit support system of the present invention includes, in the vicinity of a movement path of a mobile unit (wherein the mobile unit is made of a magnetic member or has at least one magnetic member), plural magnetic sensors disposed at predetermined intervals along a line which is substantially perpendicular to a movement direction of the mobile unit, and at least one centralized processing device, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the centralized processing device receives signals from the transmitting means of the plural magnetic sensors and processes the signals to obtain one of: (a) deviation of the mobile unit in the movement path and (b) a distance between mobile units, and then manages movement information of the mobile unit.

Another mobile unit support system of the present invention includes, in the vicinity of a movement path of a mobile unit (wherein the mobile unit is made of a magnetic member or has at least one magnetic member), plural magnetic sensors disposed at predetermined intervals along a line which is substantially perpendicular to a movement direction of the mobile unit, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the mobile unit comprises: receiving means for receiving a signal from the transmitting means; and a processing section which: (a) processes a signal from the receiving means and informs a driver of the mobile unit of information obtained by processing the signal from the receiving means or (b) processes the signal from the receiving means and performs a movement control on the basis of the processing.

Another mobile unit support system of the present invention includes, in the vicinity of a movement path of a mobile unit (wherein the mobile unit is made of a magnetic member or has at least one magnetic member), plural magnetic sensors disposed at predetermined intervals in a plane of the movement path, and at least one centralized processing device, wherein each of the magnetic sensors comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, and wherein the centralized processing device receives signals from the transmitting means of the plural magnetic sensors and processes the signals to obtain in more detail at least one of: (a) a position in the plane of the movement path, (b) a movement direction, (c) a speed, (d) a length of the mobile unit, and (e) a distance between mobile units, and then manages movement of the mobile unit.

Another mobile unit support system of the present invention includes plural magnetic members disposed in a mobile unit and at least one magnetic sensor disposed in the vicinity of a movement path, wherein the plural magnetic members are arranged in a substantially linear manner, wherein the magnetic sensor comprises: a magnetic impedance (MI) element impedance circuit using an MI element which has an MI effect and in which an impedance is changed by a variation of a magnetic field when the mobile unit is moved; a power source which supplies a current to the MI element impedance circuit; a detector which detects a change of an electric property of an output of the MI element impedance circuit on the basis of a change of the impedance of the MI element; and transmitting means for transmitting a signal from the detector to an external processing system, wherein polarities of the plural magnetic members on a side opposite to the magnetic sensor are alternatingly inverted, and wherein the mobile unit comprises: receiving means for receiving a signal from the transmitting means; and a processing section which processes a signal from the receiving means and (a) informs a driver of the mobile unit of information obtained by processing the signal from the receiving means or (b) performs a movement control on the basis of the information.

Another mobile unit support system of the present invention includes at least one magnetic member and at least one magnetic sensor disposed in the vicinity of a movement path of a mobile unit (wherein the mobile unit is made of a dielectromagnetic material), wherein the magnetic sensor comprises: a self-oscillating circuit using a magnetic impedance (MI) element which has an MI effect; a power source which supplies a current to the self-oscillating circuit; an oscillation voltage detector; and transmitting means, wherein, in the self-oscillating circuit, an impedance of the MI element is changed by a variation of a magnetic field when the mobile unit is moved, and a frequency or an amplitude of an oscillation voltage output is changed by the change of the impedance, the oscillation voltage detector detects the change of the oscillation voltage output of the self-oscillating circuit, and the transmitting means transmits a signal from the oscillation voltage detector to an external processing system, and wherein the mobile unit comprises: receiving means for receiving a signal from the transmitting means; and a processing section which processes a signal from the receiving means and (a) informs a driver of the mobile unit of information obtained by processing the signal from the receiving means or (b) performs a movement control on the basis of the information.

Another mobile unit support system of the present invention includes at least one magnetic member and at least one magnetic sensor disposed in the vicinity of a movement path of a mobile unit (wherein the mobile unit is made of a dielectromagnetic material), wherein the magnetic sensor comprises: a self-oscillating circuit using a magnetic impedance (MI) element which has an MI effect; a power source which supplies a current to the self-oscillating circuit; an oscillation voltage detector; a digital processor having an A/D converter; and transmitting means, wherein, in the self-oscillating circuit, an impedance of the MI element is changed by a variation of a magnetic field when the mobile unit is moved, and a frequency or an amplitude of an oscillation voltage output is changed by the change of the impedance, the oscillation voltage detector detects the change of the oscillation voltage output of the self-oscillating circuit, the digital processor converts the change into a digital signal, and the transmitting means transmits a signal from the digital processor to an external processing system, and wherein the mobile unit comprises: receiving means for receiving a signal from the transmitting means; and a processing section which processes a signal from the receiving means and (a) informs a driver of the mobile unit of information obtained by processing the signal from the receiving means or (b) performs a movement control on the basis of the information.

Another mobile unit support system of the present invention includes at least one magnetic member and at least one magnetic sensor disposed in the vicinity of a movement path of a mobile unit (wherein the mobile unit is made of a dielectromagnetic material), wherein the magnetic sensor comprises: a self-oscillating circuit using a magnetic impedance (MI) element which has an MI effect; a power source which supplies a current to the self-oscillating circuit; a DC voltage detector; and transmitting means, wherein, in the self-oscillating circuit, an impedance of the MI element is changed by a variation of a magnetic field when the mobile unit is moved, and an amplitude of an oscillation voltage output is changed by the change of the impedance, the DC voltage detector detects the change of the amplitude of the oscillation voltage output of the self-oscillating circuit, and obtains, from the change, movement information of each mobile unit indicative of one of: (a) a speed, (b) a movement direction, (c) a position in the movement path, (d) a length of the mobile unit, (e) a width of the mobile unit, and (f) a distance between the mobile unit and the path, and the transmitting means transmits the movement information from the DC voltage detector to an external processing system, and wherein the mobile unit comprises: receiving means for receiving a signal from the transmitting means; and a processing section which processes a signal from the receiving means and (a) informs a driver of the mobile unit of information obtained by processing the signal from the receiving means or (b) performs a movement control on the basis of the information.

Another mobile unit support system of the present invention includes at least one magnetic member and at least one magnetic sensor disposed in the vicinity of a movement path of a mobile unit (wherein the mobile unit is made of a dielectromagnetic material), wherein the magnetic sensor comprises: a self-oscillating circuit using a magnetic impedance (MI) element which has an MI effect; a power source which supplies a current to the self-oscillating circuit; an FM detector; and transmitting means, wherein, in the self-oscillating circuit, an impedance of the MI element is changed by a variation of a magnetic field when the mobile unit is moved, and a frequency of an oscillation voltage output is changed by the change of the impedance, the FM detector detects the change of the frequency of the oscillation voltage output of the self-oscillating circuit, and obtains, from the change, movement information for each mobile unit indicative of one of: (a) a speed, (b) a movement direction, (c) a position in the movement path, (d) a length of the mobile unit, (e) a width of the mobile unit, and (f) a distance between the mobile unit and the path, and the transmitting means transmits the movement information from the FM detector to an external processing system, and wherein the mobile unit comprises: receiving means for receiving a signal from the transmitting means; and a processing section which processes a signal from the receiving means and (a) informs a driver of the mobile unit of information obtained by processing the signal from the receiving means or (b) performs a movement control on the basis of the information.

Another mobile unit support system of the present invention includes a magnetic member and at least one magnetic sensor disposed separate from each other by a predetermined distance and in the vicinity of a movement path of a mobile unit (wherein the mobile unit has a radio wave generating means and is made of a dielectromagnetic material), wherein the magnetic sensor comprises a current supply section, an impedance circuit using an MI element, an output detection section, and transmitting means, wherein the current supply section receives a radio wave from the radio wave generating means of the mobile unit, and supplies an AC carrier current to the impedance circuit, from an energy of the radio wave, wherein, in the impedance circuit, an impedance of the MI element is changed by a variation of a magnetic field when the mobile unit approaches, the output detection section produces an output in which, with respect to an input from the current supply section, a frequency or an amplitude is changed, and wherein the transmitting means transmits a signal from the output detection section to an external processing system.

Another mobile unit support system of the present invention includes a magnetic member and at least one oscillation magnetic sensor disposed separate from each other by a predetermined distance and in the vicinity of a movement path of a mobile unit (wherein the mobile unit has a radio wave generating means and is made of a dielectromagnetic material), wherein the magnetic sensor comprises: a Colpitts oscillating circuit which uses at least one MI element and a transistor and which is operated by a DC current; an external power source which applies a DC voltage output obtained by performing diode detection on a radio wave input from the radio wave generating means when the mobile unit approaches to a point between a collector of the transistor and a ground; an oscillation voltage detector; and transmitting means, wherein, in the oscillating circuit, which oscillates when the mobile unit approaches, an impedance of the MI element is changed by a variation of a magnetic field formed by the magnetic member when the mobile unit is moved, and a frequency or an amplitude of an oscillation voltage output is changed by the change of the impedance, wherein the oscillation voltage detector detects the change of the oscillation voltage output of the oscillating circuit, and the transmitting means transmits a detection signal to an external processing system.

Another mobile unit support system of the present invention includes at least one oscillation sensor disposed in the vicinity of a movement path of a mobile unit (wherein the mobile unit has a radio wave generating means), wherein the oscillation sensor comprises: an oscillation circuit; an oscillation induction section which, in response to an input of a radio wave from the radio wave generating means when the mobile unit approaches, sets the oscillation circuit to be in an oscillation state; an oscillation voltage detector which detects a change of an oscillation voltage output of the oscillating circuit; and transmitting means for transmitting a signal from the oscillation voltage detector to an external processing system, and wherein the mobile unit comprises: receiving means for receiving a signal from a transmitting antenna; and a processing section which processes a signal from the receiving means and informs a driver of the mobile unit of information obtained by processing the signal from the receiving means or performs a movement control on the basis of the information.

Another mobile unit support system of the present invention includes a magnetic member and at least one magnetic sensor disposed separate from each other by a predetermined distance and in the vicinity of a movement path of a mobile unit (wherein the mobile unit has a radio wave generating means and is made of a dielectromagnetic material), wherein the magnetic sensor comprises: a Colpitts oscillating circuit which uses at least one MI element and a transistor and which is operated by a DC current; an internal excitation power source which applies a predetermined voltage between a base and an emitter of the transistor so that the oscillating circuit enters an oscillation excitation state; an antenna which, in response to an input of a radio wave from the radio wave generating means when the mobile unit approaches, causes the voltage of the internal excitation power source to be changed so that the oscillating circuit enters an oscillation state; an oscillation voltage detector; and transmitting means, wherein, in the oscillating circuit, which oscillates when the mobile unit approaches, an impedance of the MI element is changed by a variation of a magnetic field formed by the magnetic member when the mobile unit is moved, and a frequency or an amplitude of an oscillation voltage output is changed by the change of the impedance, wherein the oscillation voltage detector detects the change of the oscillation voltage output of the oscillating circuit, and the transmitting means transmits a detection signal to an external processing system.

Another mobile unit support system of the present invention includes at least one oscillation sensor disposed in the vicinity of a movement path of a mobile unit (wherein the mobile unit has a radio wave generating means and is made of a dielectromagnetic material), wherein the magnetic sensor comprises a receiving antenna, an MI element impedance circuit using an MI element, an amplifier, and a transmitting antenna, wherein the receiving antenna receives a radio wave from the radio wave generating means of the mobile unit, and supplies a high-frequency signal to the MI element impedance circuit, wherein the MI element impedance circuit produces an output in which, with respect to an input of the high-frequency signal from the receiving antenna, a frequency or an amplitude is changed by a change of an impedance of the MI element due to a variation of a magnetic field when the mobile unit approaches, wherein the amplifier amplifies an output signal from the MI element impedance circuit, wherein the transmitting antenna transmits a signal from the amplifier to an external processing system, and wherein the mobile unit comprises: receiving means for receiving a signal from the transmitting antenna; and a processing section which processes a signal from the receiving means and (a) informs a driver of the mobile unit of information obtained by processing the signal from the receiving means or (b) performs a movement control on the basis of the information.

BRIEF DESCRIPTION OF THE DRAWINGS

FIGS. 6(*a*) through 6(*c*) are diagrams showing examples of the disposition of magnetic sensors and magnetic members in the mobile unit support system of the third embodiment of the invention.

PREFERRED EMBODIMENTS OF THE INVENTION

Hereinafter, the invention will be described with reference to the drawings showing various embodiments.

Figure 1:
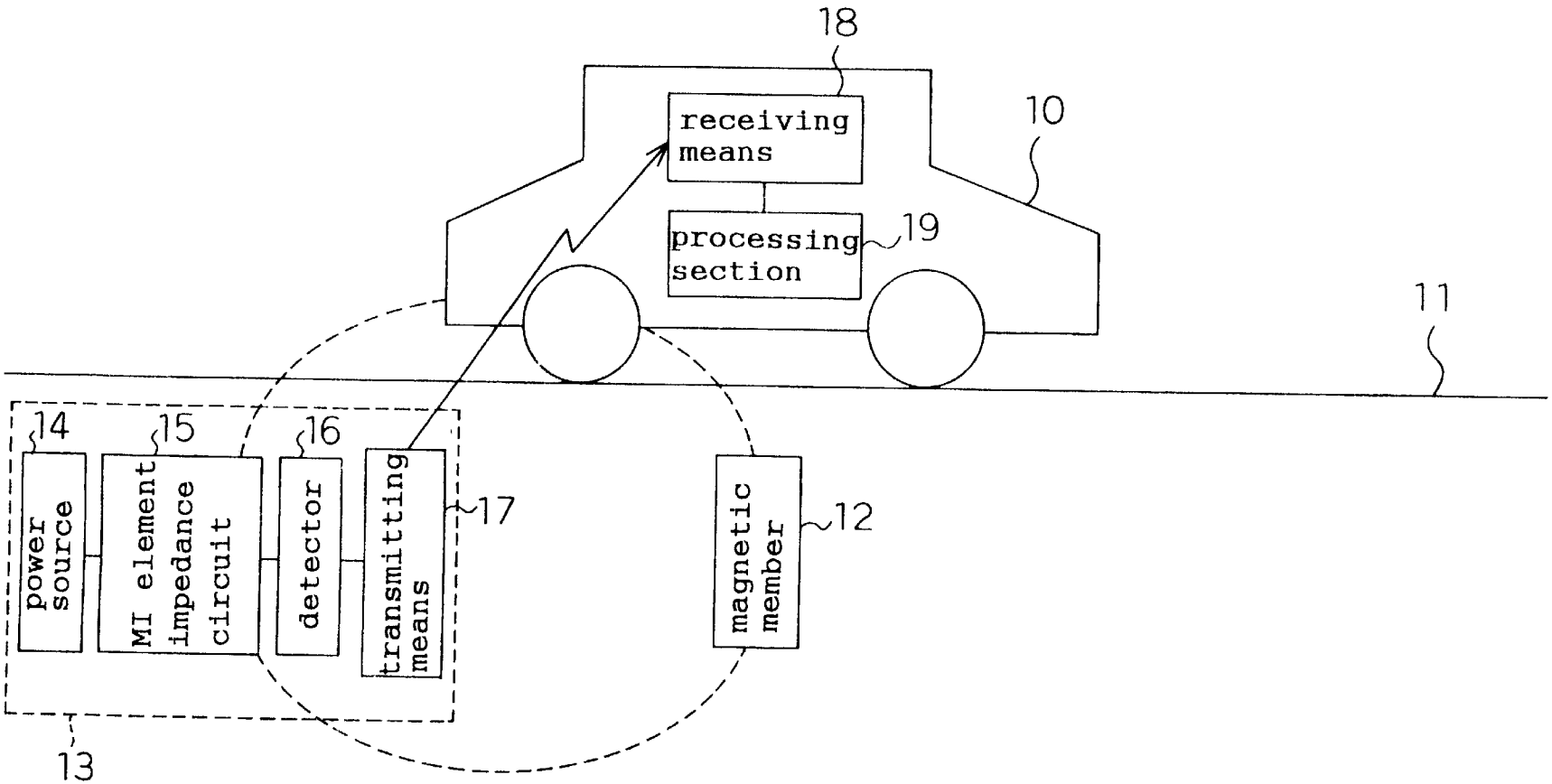
FIG. 1 is a diagrammatic configuration view showing an example of a mobile unit support system of a first embodiment of the invention.

FIG. 1 is a diagrammatic configuration view showing an example of a mobile unit support system of a first embodiment of the invention. In the mobile unit support system of this embodiment, a magnetic member, for forming a magnetic field, and a magnetic sensor are placed in the vicinity of a movement path of a mobile unit, which is made of a dielectromagnetic material, such as an automobile.

The magnetic sensor comprises an MI element impedance circuit, a power source, a detector, and transmitting means. The mobile unit has a configuration which comprises receiving means and a processing section. As shown in the figure, for example, the magnetic member 12 for forming a magnetic field, and the magnetic sensor 13 are placed in the vicinity of a movement path 11 of a mobile unit 10, which is made of a dielectromagnetic material.

In the magnetic sensor 13, the power source 14 supplies a current to the MI element impedance circuit 15. A magnetic impedance (MI) element has an MI effect. In the element, the impedance is changed by a variation of the magnetic field when the mobile unit 10 is moved. Therefore, the electrical properties of the output of the MI element impedance circuit 15 are changed by the passage of the mobile unit 10. A detector 16 detects the change and produces a detection signal. A transmitting means 17 transmits the detection signal to the mobile unit 10. In the mobile unit 10, a receiving means 18 receives the signal, and a processing section 19 processes a signal from the receiving means 18, and informs the driver of the mobile unit of the obtained information, or performs a movement control on the basis of the information.

According to this configuration, the movement information of the mobile unit can be detected with high sensitivity, and the movement of the mobile unit can be highly supported.

Figure 2A:
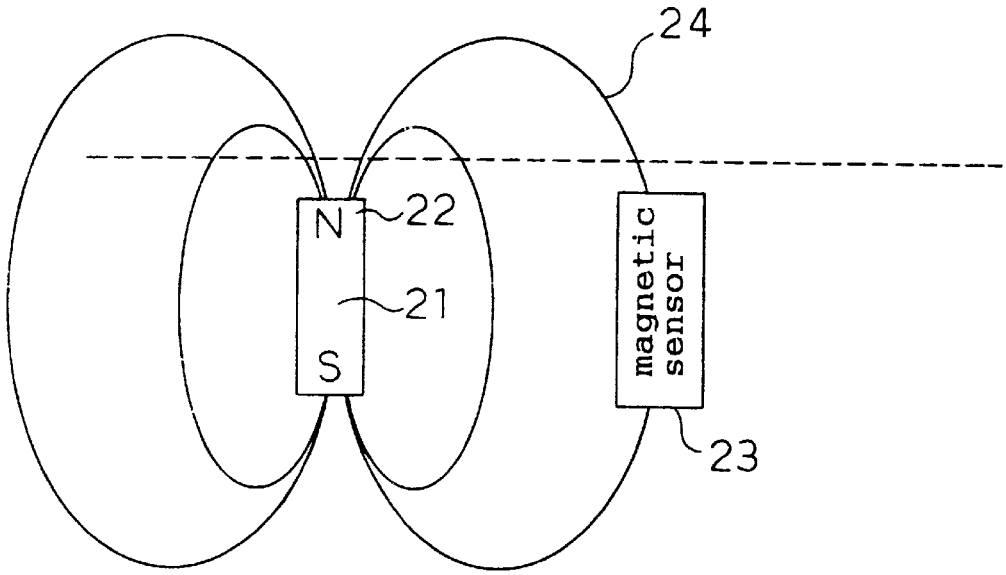
FIGS. 2(*a*) and 2(*b*) are diagrams showing functions of a magnetic member and a magnetic sensor in the first embodiment.
Figure 2B:
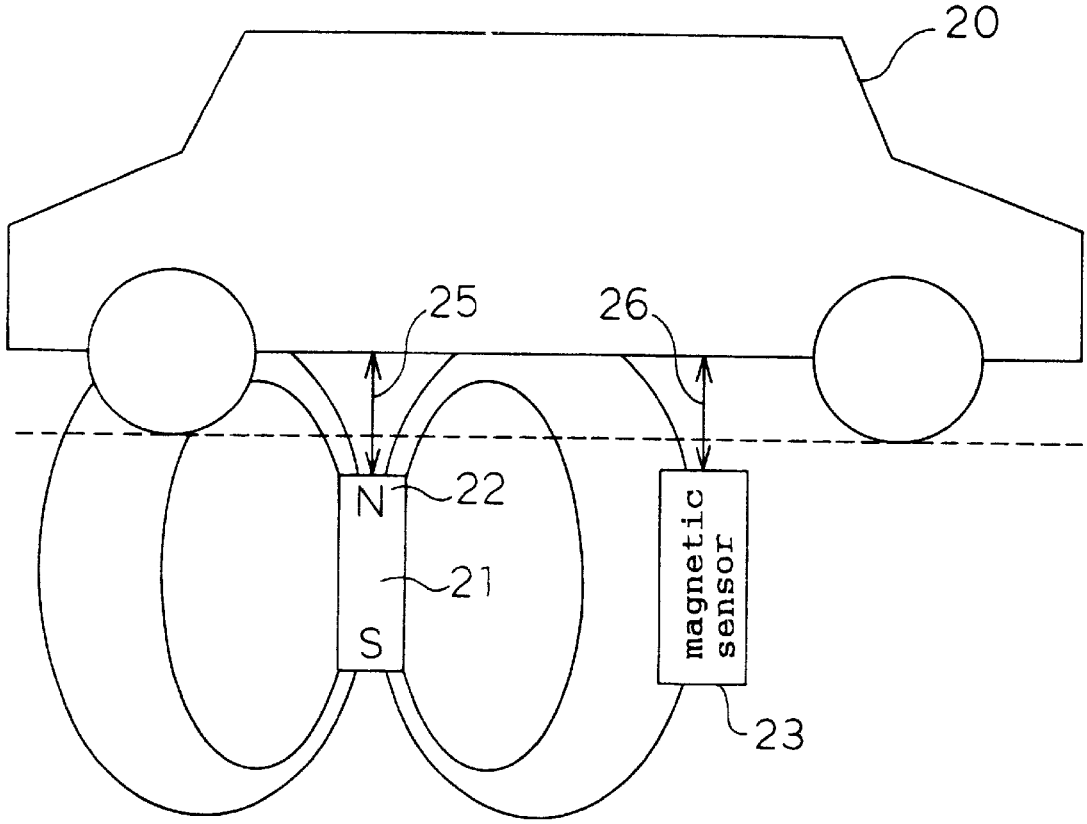

FIGS. 2(*a*) and 2(*b*) show the positional relationship between the magnetic member and the magnetic sensor in this embodiment.

FIG. 2(*a*) shows a state where no mobile unit exists, and FIG. 2(*b*) shows a state where a mobile unit 20 passes over the magnetic sensor 23. As shown in the figures, for example, the condition of the magnetic field in the state where a mobile unit 20 exists is different from that in the state where the mobile unit does not exist, and also the magnetic resistance is changed. The magnetic sensor 23 detects these changes.

In these figures, reference number 22 indicates a magnetic pole, 23 indicates a magnetic sensor, 24 indicates a distance along a line of magnetic force between a magnetic member 21 and a magnetic sensor 23, 25 indicates a distance between the magnetic member 21 and a mobile unit 20, and 26 indicates a distance between the magnetic sensor 23 and the mobile unit 20.

According to this configuration, the movement information of the mobile unit 20 can be detected with high sensitivity.

Figure 3A:
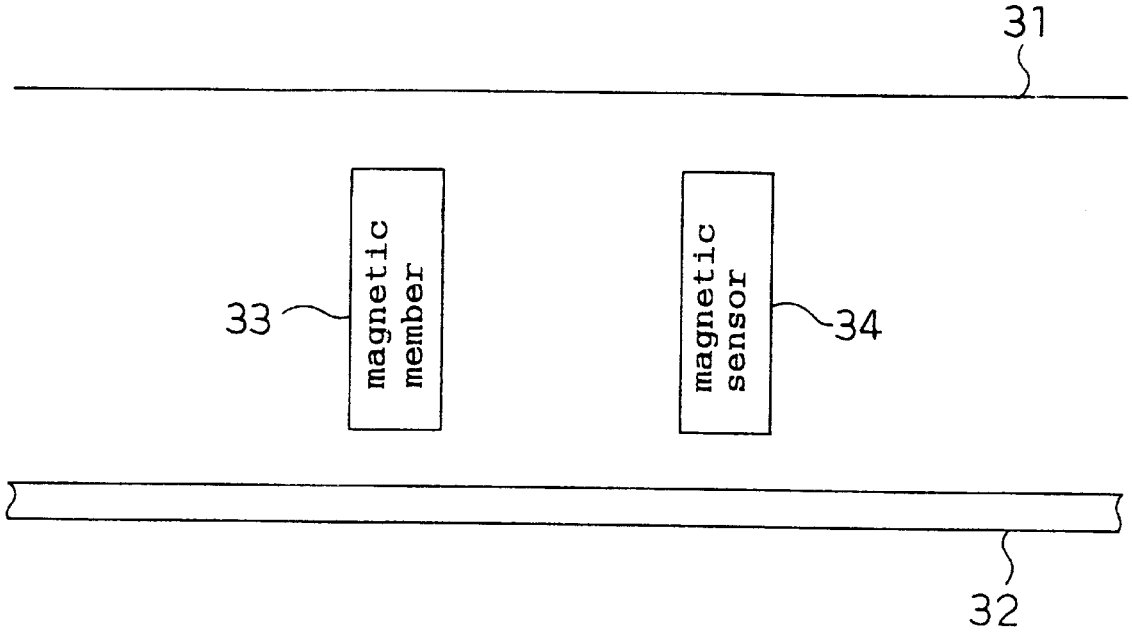
FIGS. 3(*a*) and 3(*b*) are diagrammatic configuration views showing an example of a mobile unit support system of a second embodiment of the invention.
Figure 3B:
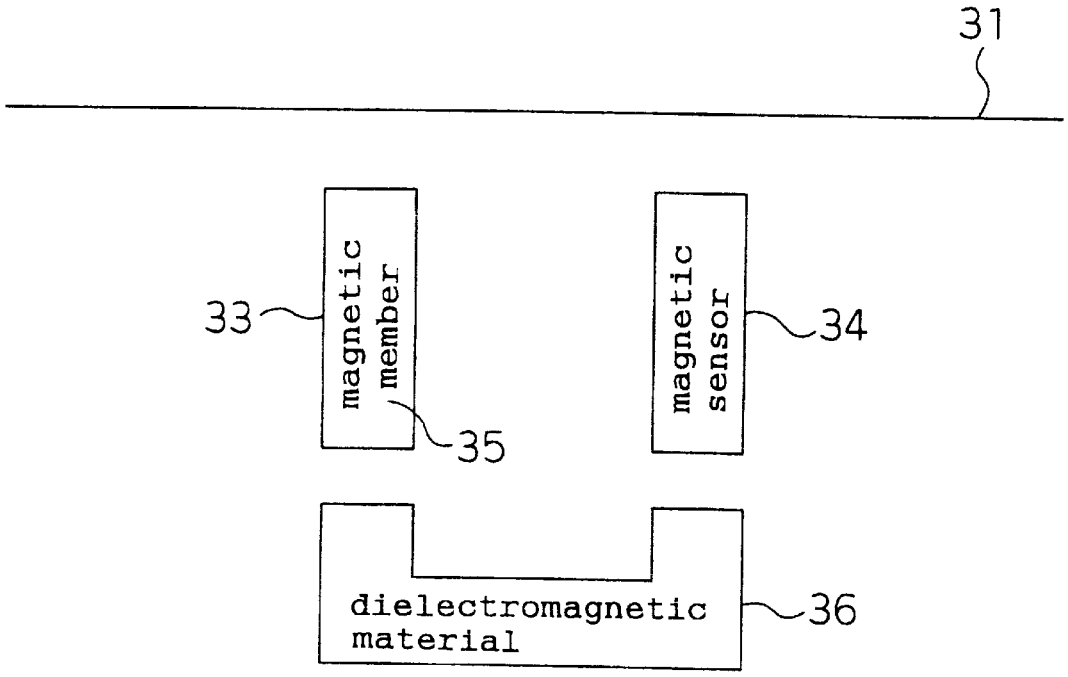

FIGS. 3(*a*) and 3(*b*) are diagrammatic configuration views showing an example of a mobile unit support system of a second embodiment of the invention. This embodiment is different from the first embodiment in that a dielectromagnetic material is disposed below a magnetic member and a magnetic sensor (at a side opposite to a movement path 31 or in the ground). As shown in FIG. 3(*a*), for example, the magnetic member 33 and the magnetic sensor 34 are disposed between the movement path 31 and a dielectromagnetic material 32, such as an iron plate.

As shown in FIG. 3(*b*), preferably, the dielectromagnetic material 36 has a bent shape so that both the tip ends are opposed to the lower ends of the magnetic member 33 and the magnetic sensor 34, respectively.

According to this configuration also, the movement information of a mobile unit can be detected with high sensitivity.

Figure 4:
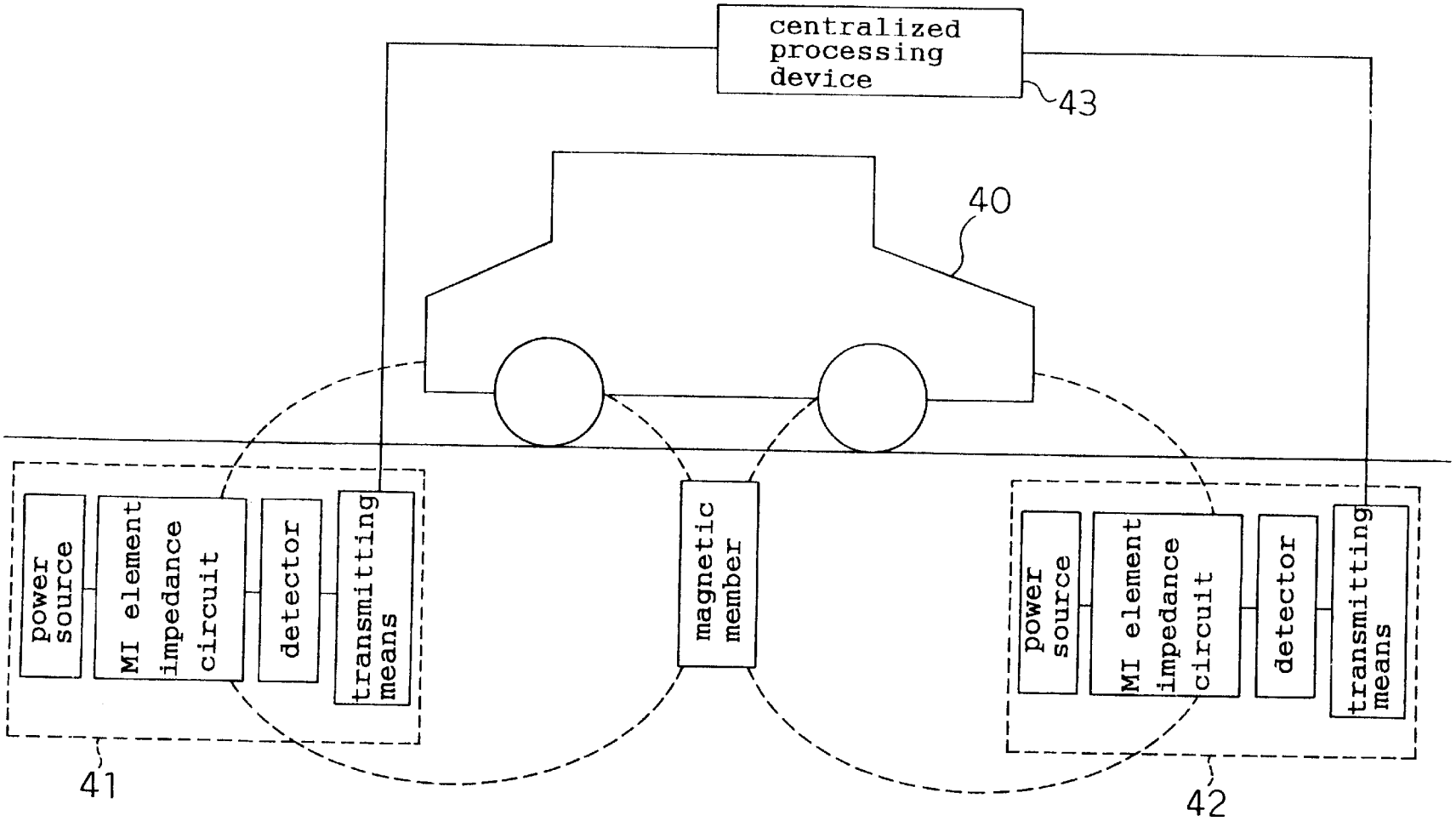
FIG. 4 is a diagrammatic configuration view showing an example of a mobile unit support system of a third embodiment of the invention.

FIG. 4 is a diagrammatic configuration view showing an example of a mobile unit support system of a third embodiment of the invention. The mobile unit support system of this embodiment has a configuration in which a magnetic member for forming a magnetic field, plural magnetic sensors 41 and 42, and a centralized processing device 43 are placed in the vicinity of a movement path of a mobile unit 40, wherein the mobile unit 40 is made of a dielectromagnetic material. Each of the magnetic sensors 41 and 42 comprises an MI element impedance circuit, a power source, a detector, and transmitting means.

As shown in the figure, in the same manner as the first embodiment, the magnetic sensors 41 and 42 detect a variation of the magnetic field in various passing states of various mobile units 40 (which are made of a dielectromagnetic material), and transmit a signal indicative of the variation. The centralized processing device 43 receives the information from the plural magnetic sensors 41 and 42 and synthetically processes the information, thereby highly managing the movement condition information of plural mobile units in the movement path.

Figure 5A:
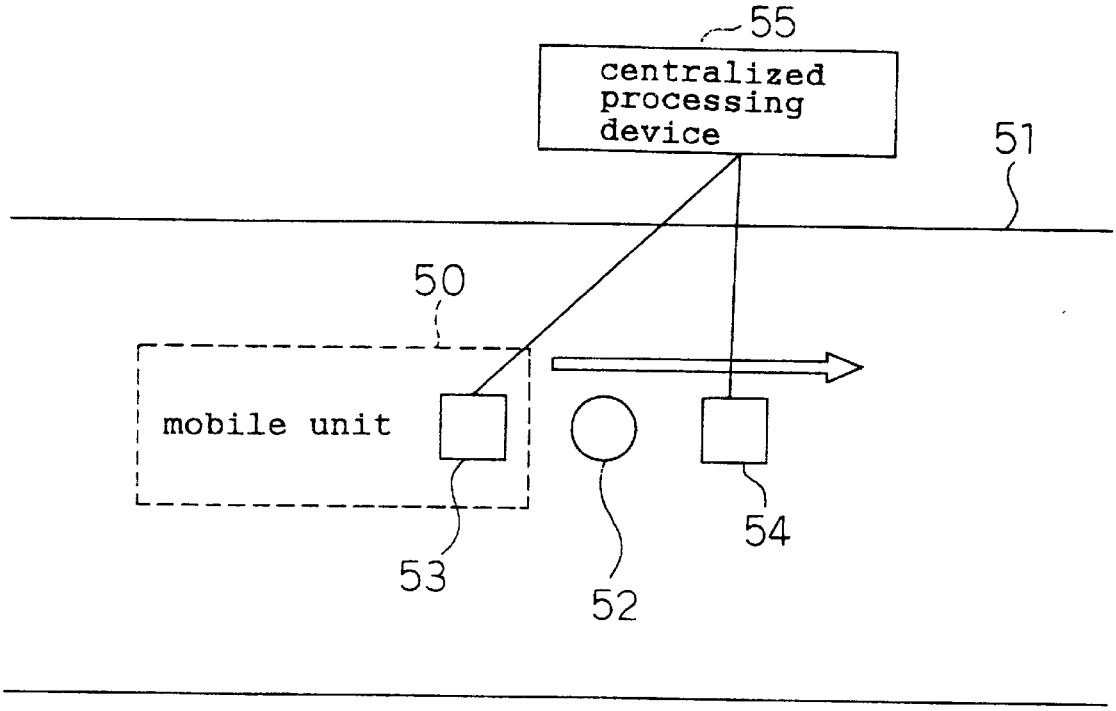
FIGS. 5(*a*) and 5(*b*) are diagrams showing examples of the disposition of magnetic sensors in the mobile unit support system of the third embodiment of the invention.
Figure 5B:
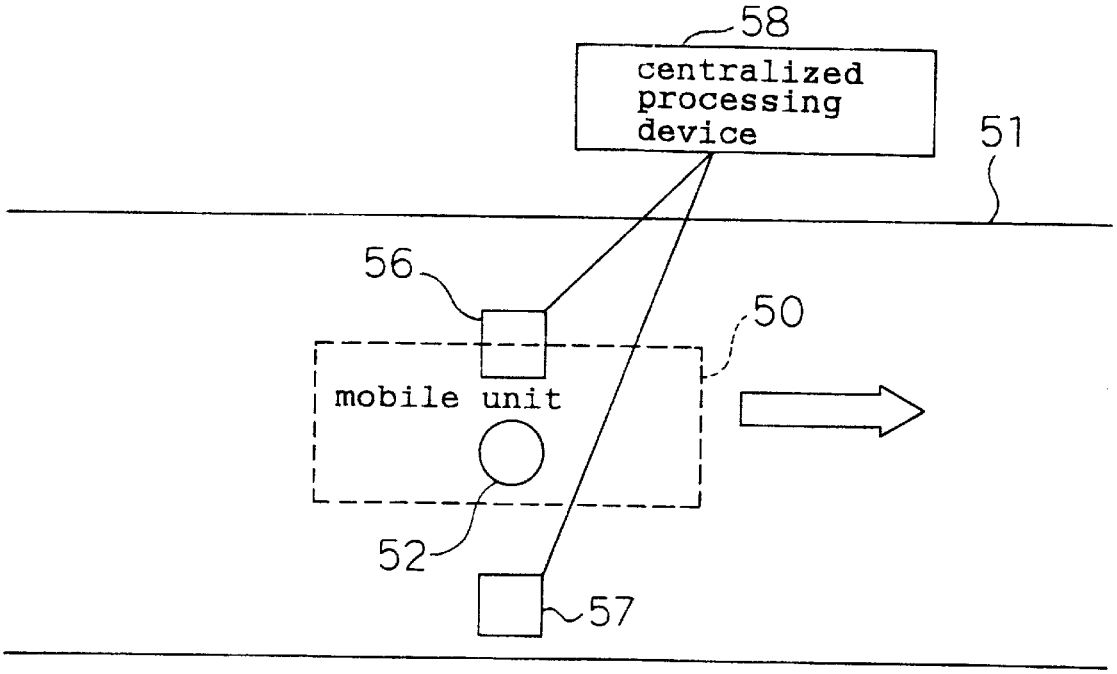

FIG. 5(*a*) shows a case where, in the embodiment described above, plural magnetic sensors 53 and 54 are placed separated from each other by a predetermined distance along the movement direction of a mobile unit 50, and FIG. 5(*b*) shows a case where plural magnetic sensors 56 and 57 are placed separated from each other by a predetermined distance along a line which is substantially perpendicular to the movement direction of a mobile unit 50.

When, as shown in FIG. 5(*a*), a magnetic member 52 for forming a magnetic field and plural magnetic sensors 53 and 54 are placed in the vicinity of a movement path 51 of the mobile unit 50 and along the movement direction of the mobile unit 50, each of the magnetic sensors 53 and 54 transmits a signal corresponding to the position of the magnetic sensor, so that the position of the mobile unit 50 can be detected. When the mobile unit 50 passes over, a time lag is produced between the detection signals of the first and second magnetic sensors 53 and 54. When a centralized processing device 55 processes the time lag, information indicative of the movement direction, the speed, and the length of the mobile unit 50 can be detected.

When, as shown in FIG. 5(*b*), plural magnetic sensors 56 and 57 are placed along a line which is substantially perpendicular to the movement direction of the mobile unit 50, a level difference is produced between the detection signals respectively output from the magnetic sensors 56 and 57. When a centralized processing device 58 processes the level difference, it is possible to know the deviation of the mobile unit 50 in the movement path 51.

In the embodiment described above, the magnetic member 52 is placed at a substantially middle point between the two magnetic sensors. The number of magnetic sensors is not restricted to two, and may be increased to three or more. The positions of the magnetic sensors are not restricted to the above as long as the magnetic members are disposed separated from each other by a predetermined distance and in the vicinity of the movement path of the mobile unit. For example, as shown in FIG. 6(*a*) (a view of a road as seen from the top), magnetic sensors 61 and magnetic members 62 may be alternatingly disposed in a lattice manner in a path of a mobile unit.

When the above-mentioned disposition is conducted in a crossing of movement paths, a junction of movement paths, or the like, as shown in FIGS. 6(*b*) and 6(*c*), and detection signals of the magnetic sensors are synthetically processed, it is possible to know the position of the mobile units in the movement paths at any given moment. When magnetic sensors are arranged at a resolution which is smaller than the size of a mobile unit, the size of a mobile unit can be detected, and also the distance between mobile units can be detected highly accurately.

Figure 7:
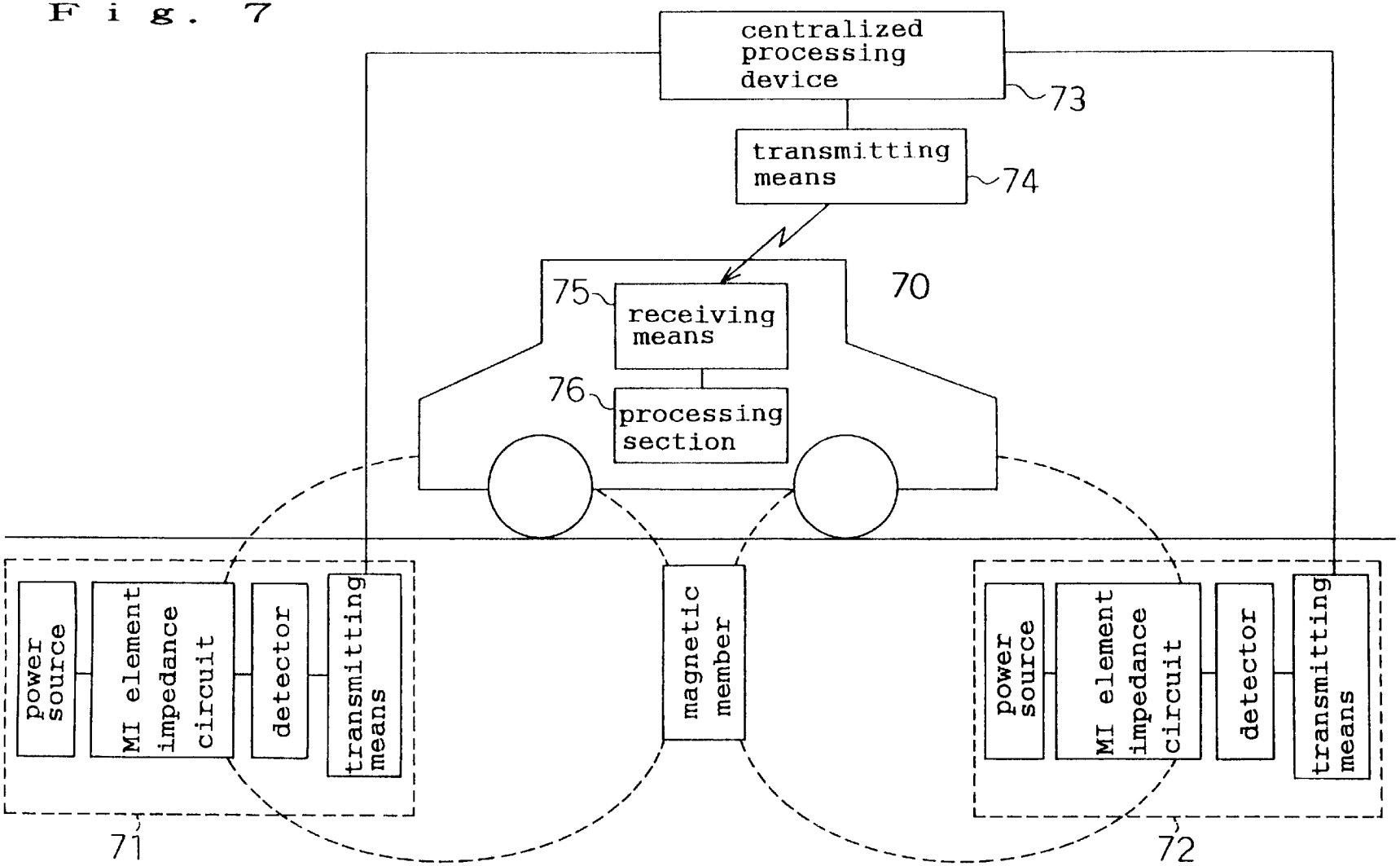
FIG. 7 is a diagrammatic configuration view showing an example of a mobile unit support system of a fourth embodiment of the invention.

FIG. 7 is a diagrammatic configuration view showing an example of a mobile unit support system of a fourth embodiment of the invention. This embodiment is different from the second embodiment in that a transmitting means for transmitting a signal from a centralized processing device 73 is disposed in the vicinity of a movement path, and the mobile unit has a receiving means and a processing section. As shown in the figure, the centralized processing device 73 receives information from plural magnetic sensors 71 and 72, synthetically processes the information, and highly manages movement condition information of plural mobile units 70 in the movement path. The transmitting means 74 transmits a signal from the centralized processing device 73 to a mobile unit 70. In the mobile unit 70, the receiving means 75 receives the signal, and the processing section 76 processes a signal from the receiving means 75 and informs the driver of the mobile unit 70 of information indicative of the result of the processing or performs a movement control on the basis of the information of the result.

According to this configuration, movement information of a mobile unit can be detected with high sensitivity, and the movement of the mobile unit can be highly supported.

Figure 8A:
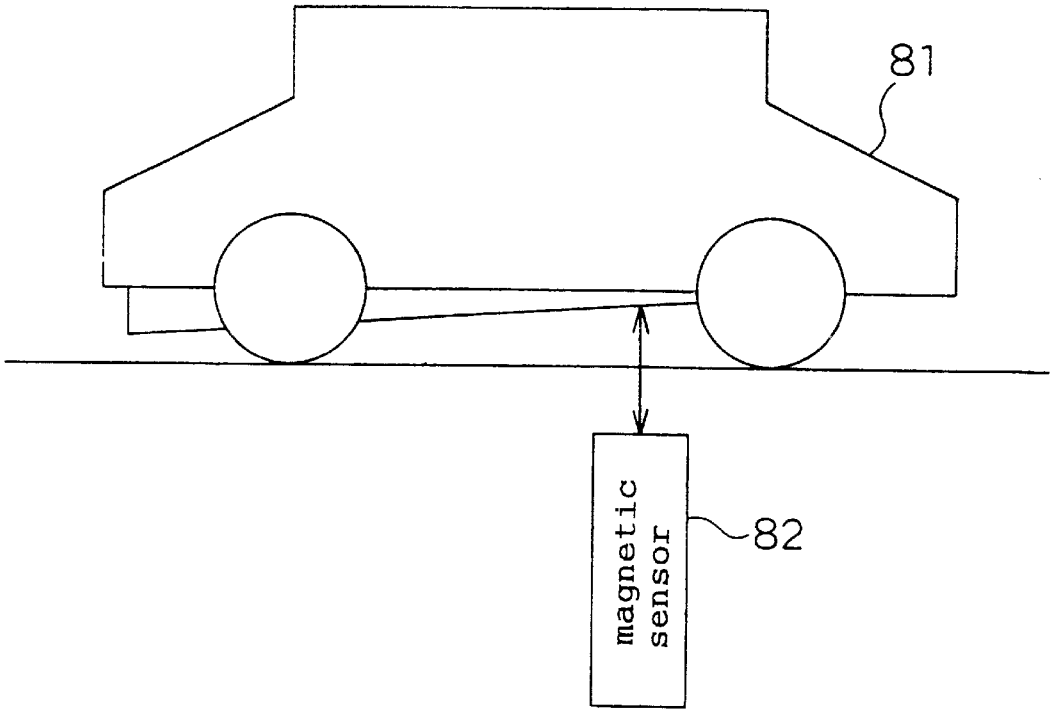
FIGS. 8(*a*) and 8(*b*) are diagrams showing examples of the shape of the mobile unit in the first to fourth embodiments of the invention.
Figure 8B:
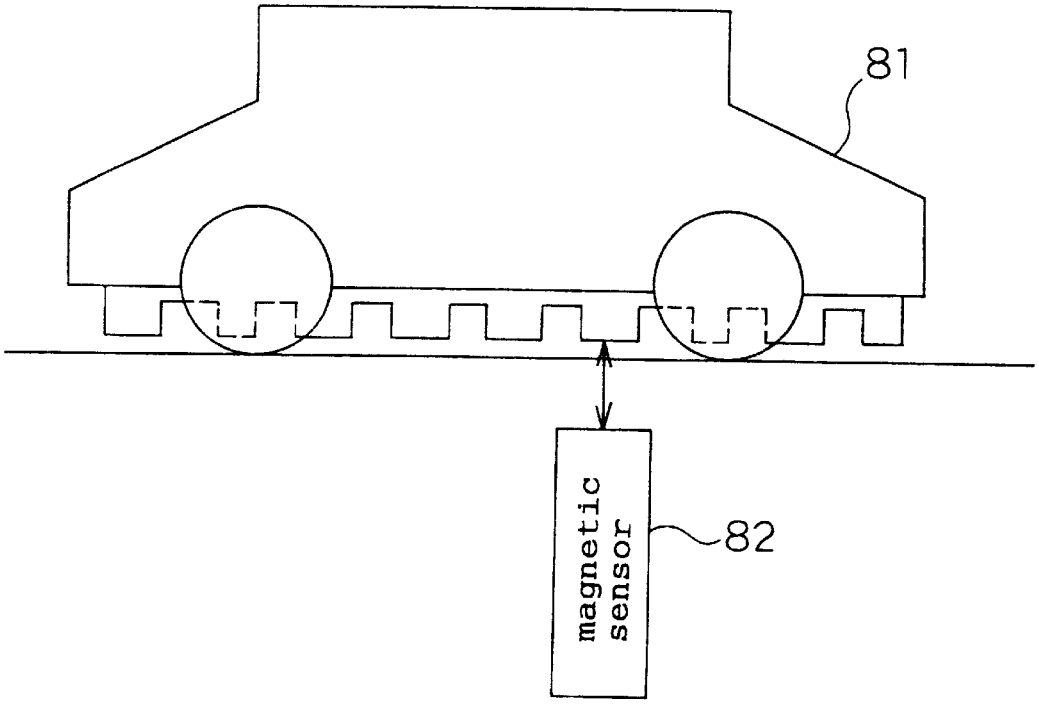

FIGS. 8(*a*) and 8(*b*) are diagrams showing examples of the shape of the mobile unit in the first to fourth embodiments of the invention. As shown in the figures, a mobile unit 81 made of a dielectromagnetic material has a portion which is close to a magnetic sensor 82 and which is configured so that the distance between the portion and the magnetic sensor 82 is changed.

As shown in FIG. 8(*a*), for example, when the mobile unit 81 passes, the distance between a magnetic sensor 82 and the mobile unit 81 changes from a front portion of the mobile unit 81 to a rear portion thereof. The magnetic field is varied not only at a time immediately before and after the passage of the mobile unit 81, but also in a period when the mobile unit 81 passes over the magnetic sensor 82. When the change of a detection signal of the magnetic sensor 82 is subjected to a differential process, the speed of the mobile unit 81 can be detected using only one magnetic sensor 82. As shown in FIG. 8(*b*), alternatively, projected and recessed portions may be formed at a predetermined number or at predetermined intervals along the mobile unit 81.

Figure 9:
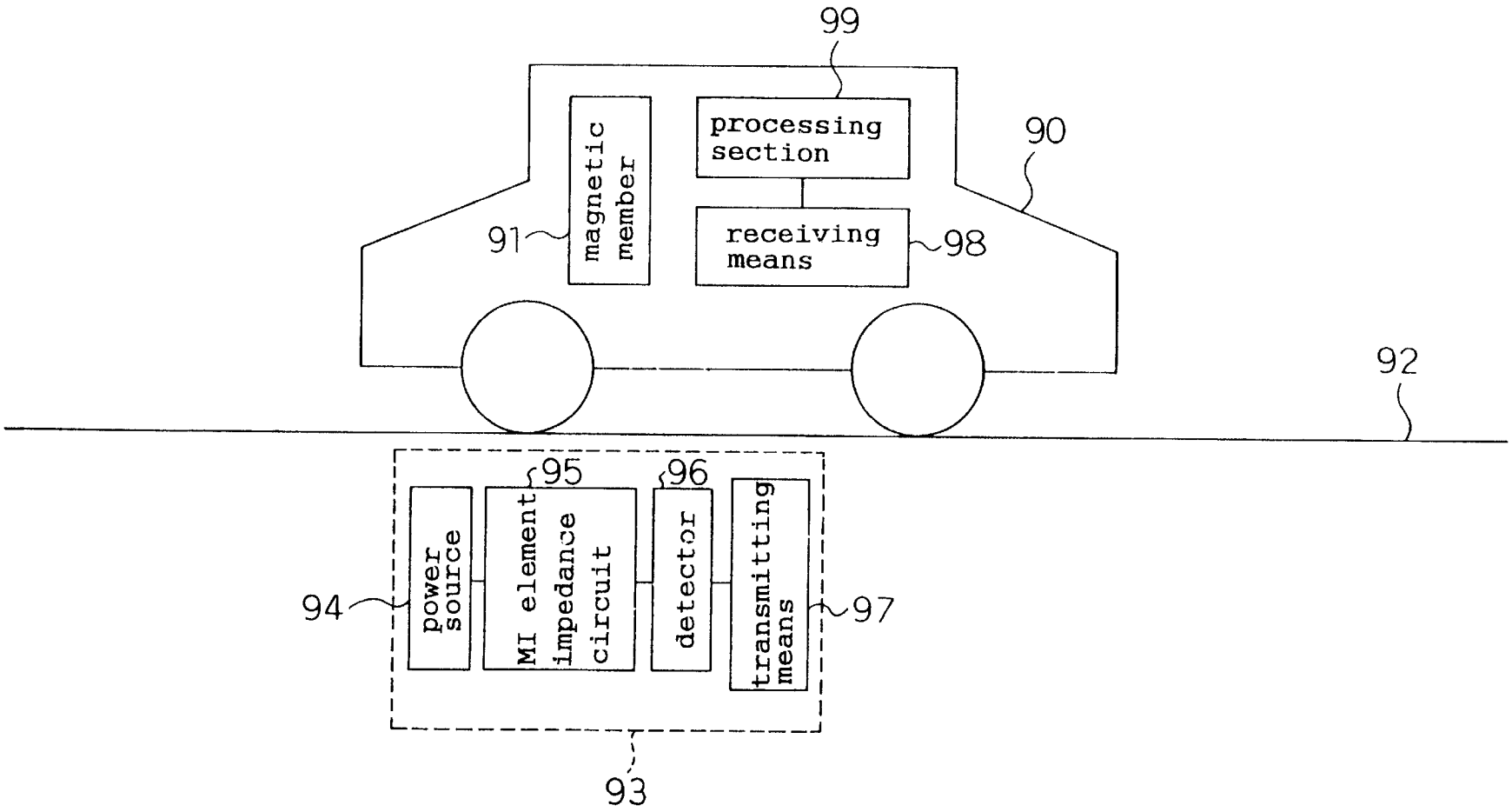
FIG. 9 is a diagrammatic configuration view showing an example of a mobile unit support system of a fifth embodiment of the invention.

FIG. 9 is a diagrammatic configuration view showing an example of a mobile unit support system of a fifth embodiment of the invention. This embodiment is different from the first embodiment in that a mobile unit 90 has a magnetic member 91. As shown in the figure, for example, a magnetic sensor 93 is disposed in the vicinity of a movement path 92 of a mobile unit 90 having a magnetic member 91. In the magnetic sensor 93, a power source 94 supplies a current to an MI element impedance circuit 95. A magnetic impedance (MI) element has an MI effect. In the element, the impedance is changed by a variation of the magnetic field when the mobile unit 90 is moved.

Therefore, the electrical properties of the output of the MI element impedance circuit 95 are changed by the passage of the mobile unit 90. A detector 96 detects the change and produces a detection signal. Transmitting means 97 transmits the detection signal to the mobile unit 90. In the mobile unit 90, receiving means 98 receives the signal, and a processing section 99 processes a signal from the receiving means 98, and informs the driver of the mobile unit 90 of the obtained information, or performs a movement control on the basis of the information. The figure shows the case where the mobile unit 90 has a magnetic material 91.

Alternatively, the mobile unit 90 itself may be made of a magnetic material.

Figure 10:
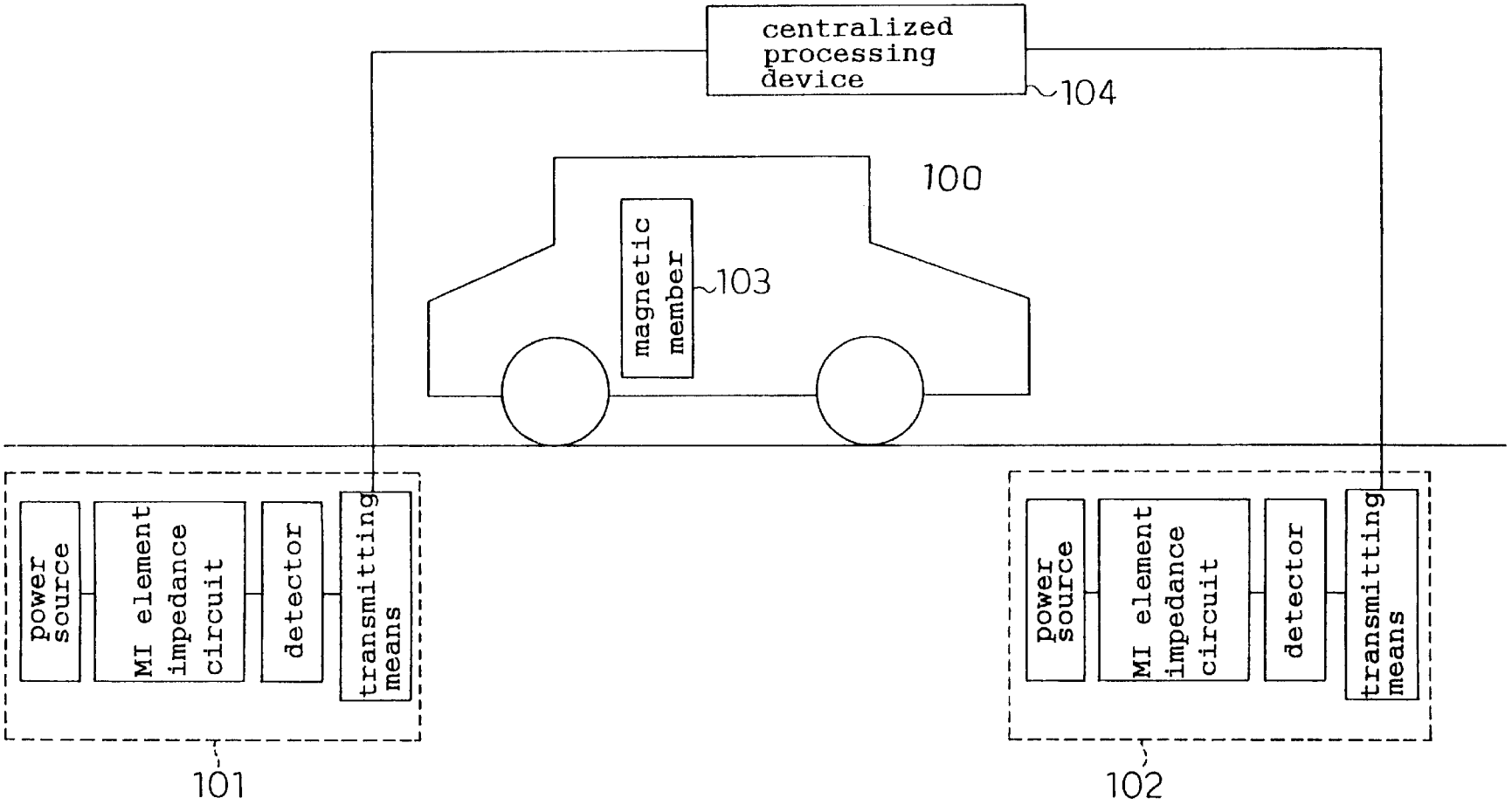
FIG. 10 is a diagrammatic configuration view showing an example of a mobile unit support system of a sixth embodiment of the invention.

FIG. 10 is a diagrammatic configuration view showing an example of a mobile unit support system of a sixth embodiment of the invention. This embodiment is different from the second embodiment in that a mobile unit 100 has a magnetic member 103. As shown in the figure, in the same manner as the fourth embodiment, magnetic sensors 101 and 102 detect a variation of the magnetic field in various passing states of various mobile units 100, each having a magnetic member 103, and transmit a signal indicative of the variation. A centralized processing device 104 receives information from the plural magnetic sensors 101 and 102 and synthetically processes the information, thereby highly managing information of the movement conditions of plural mobile units in the movement path.

The figure shows the case where a mobile unit 100 has a magnetic material 103. Alternatively, a mobile unit 100 itself may be made of a magnetic material.

Figure 11:
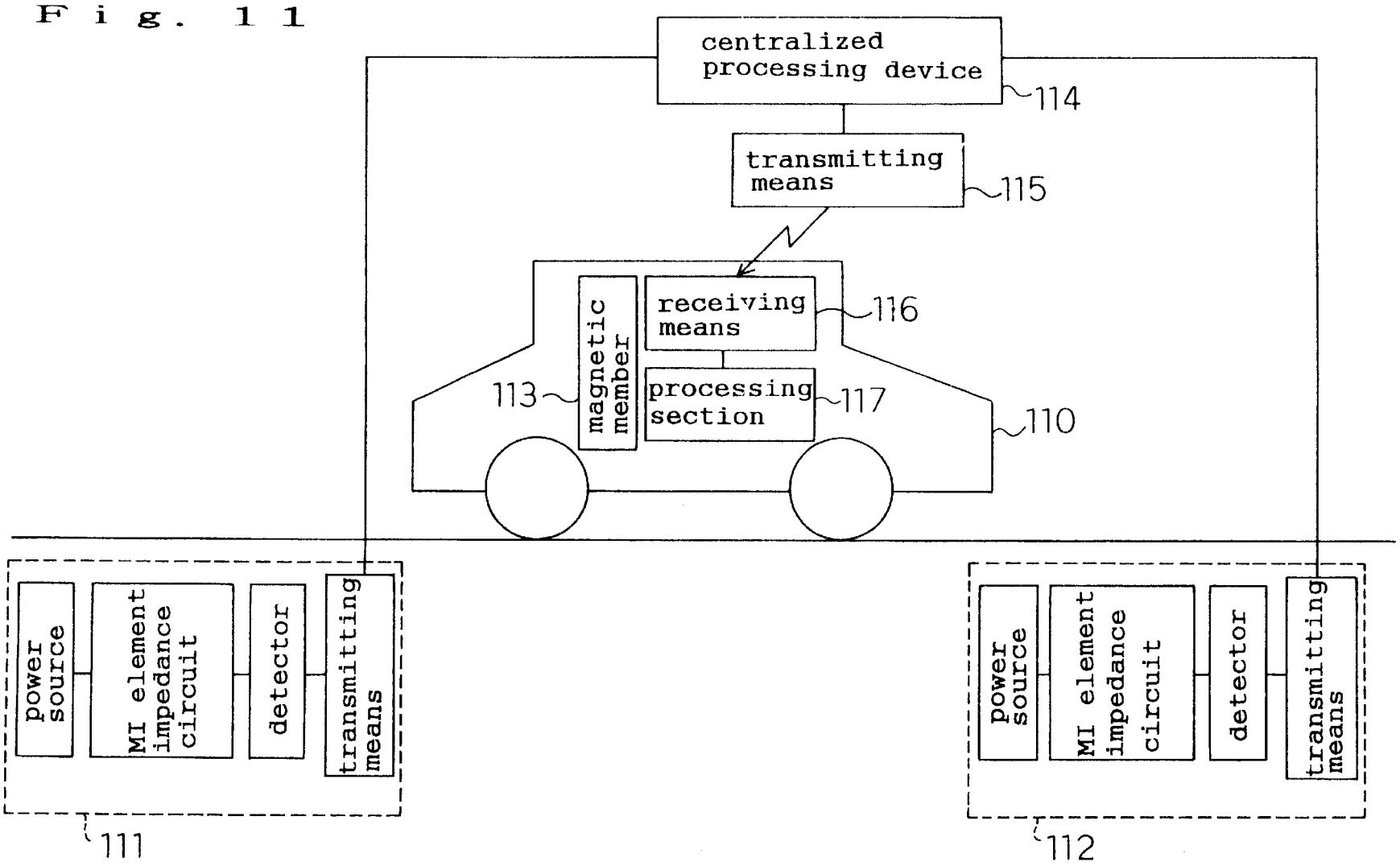
FIG. 11 is a diagrammatic configuration view showing an example of a mobile unit support system of a seventh embodiment of the invention.
Figure 12A:
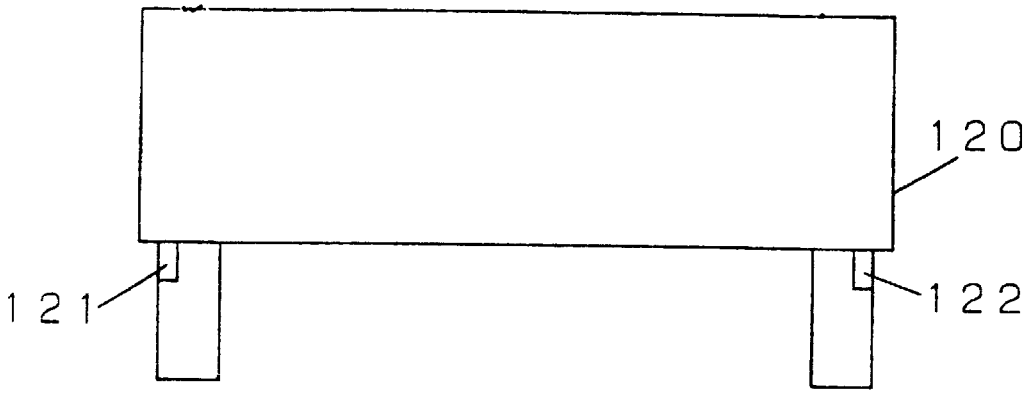
FIGS. 12(*a*) through 12(*d*) are diagrammatic configuration views showing the disposition of magnetic members of a mobile unit in the mobile unit support systems of Embodiments 5 to 7.
Figure 12B:
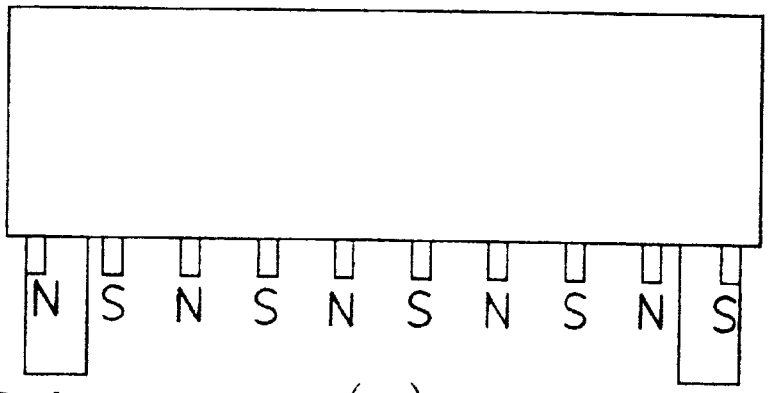
Figure 12C:
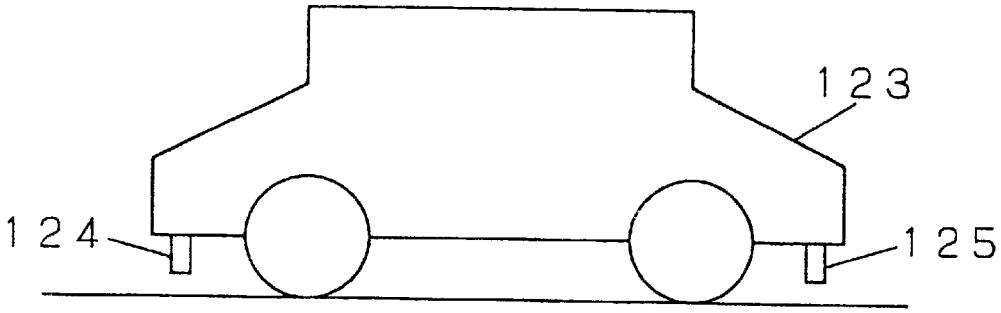
Figure 12D:
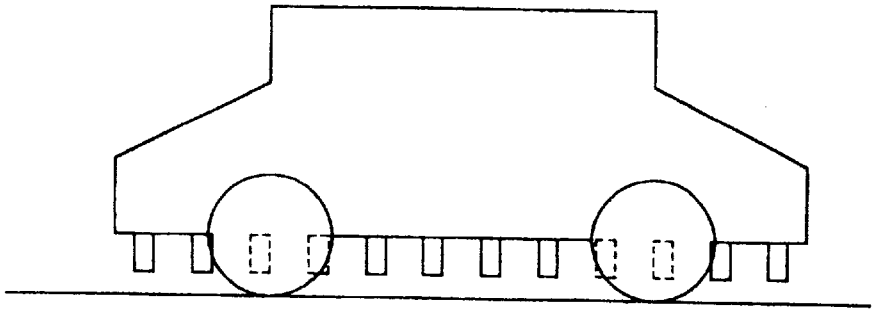

FIG. 11 is a diagrammatic configuration view showing an example of a mobile unit support system of a seventh embodiment of the invention. This embodiment is different from the third embodiment in that a mobile unit 110 has a magnetic member 113. As shown in the figure, in the same manner as the fifth embodiment, magnetic sensors 111 and 112 detect a variation of the magnetic field in various passing states of various mobile units 110, each having a magnetic member 113, and transmit a signal indicative of the variation. A centralized processing device 114 receives information from the plural magnetic sensors 111 and 112 and synthetically processes the information.

Transmitting means 115 transmits the signal to the mobile units 110. In each of the mobile units 110, receiving means 116 receives the signal, a processing section 117 processes the signal from the transmitting means 115, and informs the driver of the mobile unit 110 of the obtained information, or performs a movement control on the basis of the information.

According to this configuration, the movement information of the mobile unit 110 can be detected with high sensitivity, and the movement of the mobile unit 110 can be highly supported. The figure shows the case where a mobile unit 110 has a magnetic material 113. Alternatively, a mobile unit 110 itself may be made of a magnetic material.

FIGS. 12(*a*) through 12(*d*) are diagrammatic configuration views showing examples of the disposition of magnetic members of a mobile unit in the mobile unit support systems of Embodiments 5 to 7. In FIG. 12(*a*), for example, magnetic members 121 and 122 are disposed at the left and right ends of a mobile unit 120, respectively. As shown in FIG. 12(*b*), a predetermined number of magnetic members may be disposed at predetermined intervals between the left and right ends.

In this case, when the number of the magnetic members is preset so as to correspond to values such as the width, length, and weight of a mobile unit, the width of a mobile unit and the like can be detected by using a magnetic sensor. It is a matter of course that the deviation in the movement path also can be detected. When the magnetic members are disposed so that their polarities are alternatingly inverted, the detection of the width of a mobile unit and the like is further facilitated. FIG. 12(*c*) shows the case where magnetic members 124 and 125 are disposed in the front and rear portions of a mobile unit 123, respectively. As shown in FIG. 12(*d*), a predetermined number of magnetic members may be disposed at predetermined intervals between the front and rear portions. According to this configuration, the length of the mobile unit, the movement direction, and the movement speed can be detected by using the magnetic sensors.

Figure 13A:
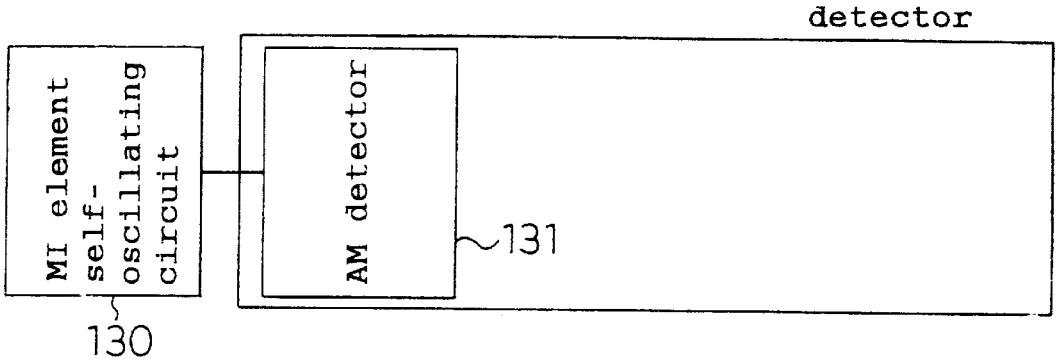
FIGS. 13(*a*) through 13(*c*) are diagrams showing the configuration of the magnetic sensor in the mobile unit support systems of Embodiments 1 to 7.
Figure 13B:
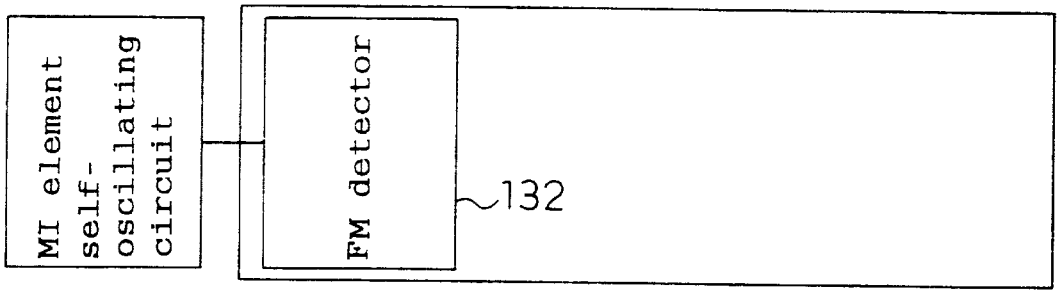
Figure 13C:
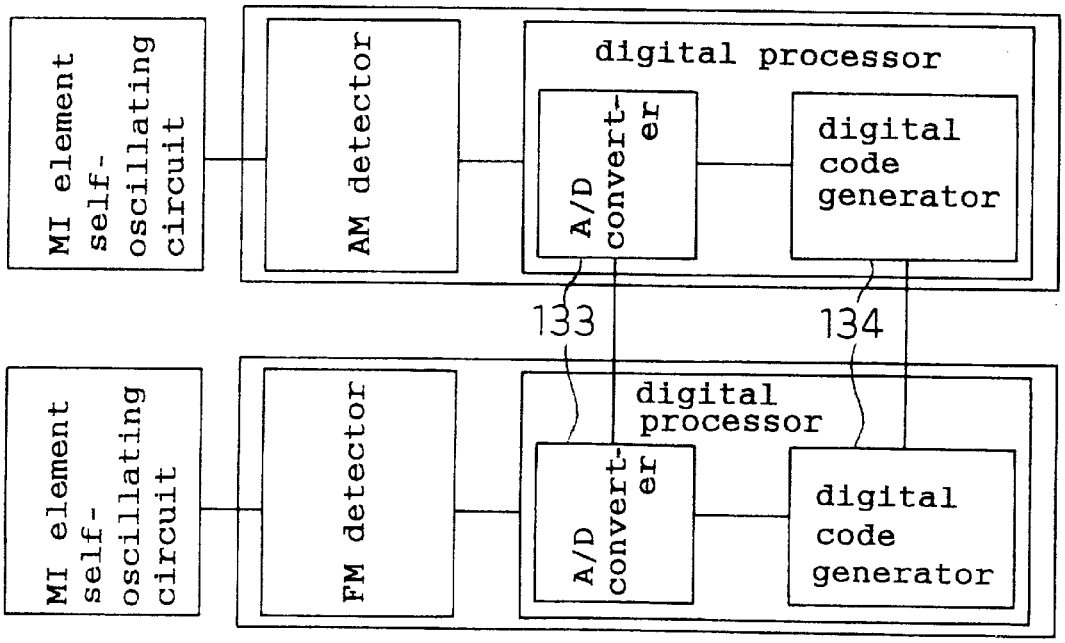

FIGS. 13(*a*) through 13(*d*) are diagrams showing in more detail the configuration of the magnetic sensor in the mobile unit support systems of Embodiments 1 to 7. FIG. 13(*a*) shows the case where an AM detector 131 is used as the detector for the output of the MI element impedance circuit, and FIG. 13(*b*) shows the case where an FM detector 132 is used as the detector. When an external magnetic field is changed, the impedance of an MI element is changed, and hence the amplitude of the oscillation voltage of an oscillating circuit and the oscillation frequency are changed. Consequently, as shown in FIG. 13(*a*), for example, the oscillation voltage output may be detected by an AM detector 131 so that a DC voltage output is obtained.

Alternatively, as shown in FIG. 13(*b*), a frequency output may be obtained based on detection by an FM detector 132. It is a matter of course that, as shown in FIG. 13(*c*), the magnetic sensor may further have an A/D converter 133 and a digital code generator 134 so that the AM or FM detection output is converted into a digital signal and then subjected to signal processing suitable for external transmission.

Figure 14A:
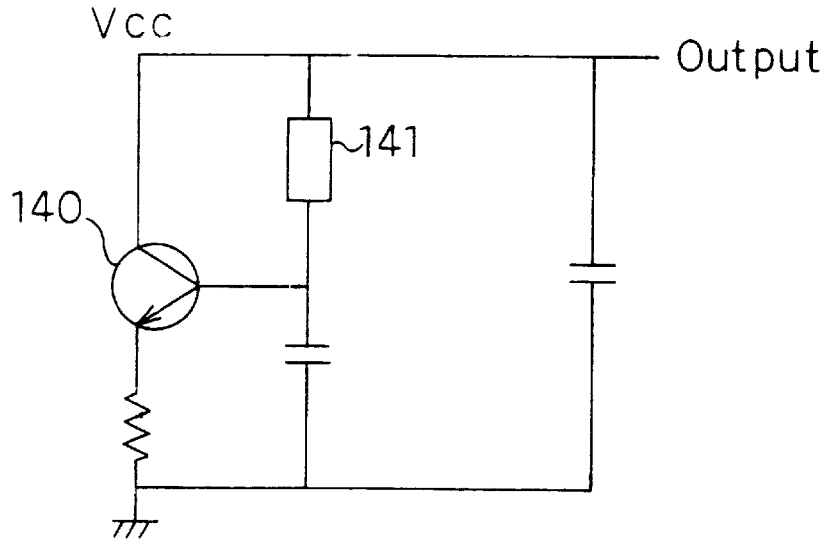
FIGS. 14(*a*) and 14(*b*) are circuit diagrams showing an example of a circuit of a magnetic sensor in the mobile unit support systems of Embodiments 1 to 7.
Figure 14B:
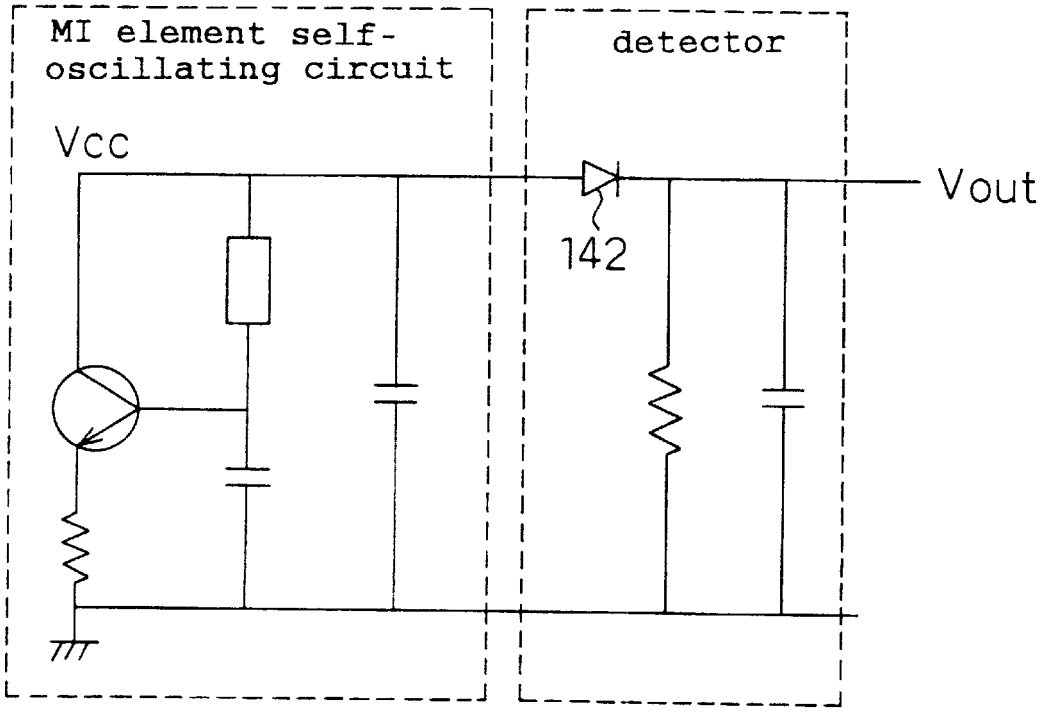

FIGS. 14(*a*) and 14(*b*) show examples of a circuit of a magnetic sensor in which a self-oscillating circuit based on an MI element is used in the MI element impedance circuit.

As shown in FIG. 14(*a*), a stabilized Colpitts oscillating circuit which uses a single transistor 140 and which is operated by a DC power source is employed as a self-oscillating circuit, and an MI element 141 is connected between the base and the collector of the transistor 140.

As shown in FIG. 14(*b*), a diode detector using a diode 142 is employed as a section for detecting the oscillation voltage output of the oscillating circuit. According to this configuration, a variation of a magnetic field can be easily detected on the basis of a change of the amplitude of the DC voltage output.

Figure 15:
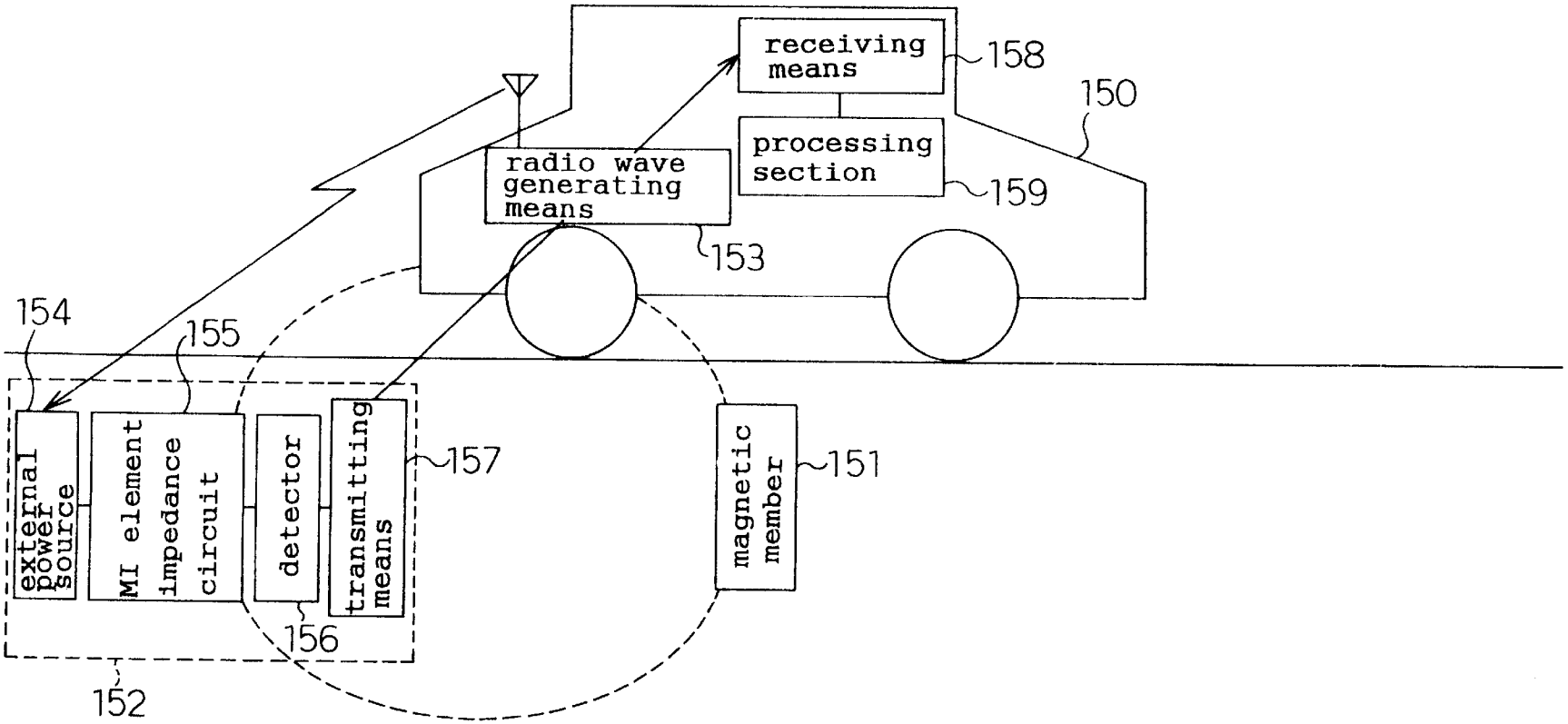
FIG. 15 is a diagrammatic configuration view showing an example of a mobile unit support system of an eighth embodiment of the invention.

FIG. 15 is a diagrammatic configuration view showing an example of a mobile unit support system of an eighth embodiment of the invention. This embodiment is different from the first embodiment in that the mobile unit 150 has a radio wave generating means 153, and the power source 154 which supplies a current to the MI element impedance circuit 155 of the magnetic sensor 152 is an external power source 154 which receives a radio wave from the radio wave generating means 153 and which performs the current supply based on the energy of the radio wave. As shown in the figure, for example, a magnetic member 151 for forming a magnetic field, and a magnetic sensor 152 are placed in the vicinity of a movement path of a mobile unit 150. The mobile unit 150 receives a radio wave from the radio wave generating means 153. In the magnetic sensor 152, an external power source 154 receives the radio wave, and a current based on the energy of the radio wave is supplied to an MI element impedance circuit 155. A magnetic impedance (MI) element has an MI effect. In the element, the impedance is changed by a variation of the magnetic field when the mobile unit 150 is moved. Therefore, the electrical properties of the output of the MI element impedance circuit 155 are changed by the passage of the mobile unit 150. A detector 156 detects the change and produces a detection signal.

Transmitting means 157 transmits the detection signal to the mobile unit 150. In the mobile unit 150, receiving means 158 receives the signal, and a processing section 159 processes a signal from the receiving means 158, and informs the driver of the mobile unit 150 of the obtained information, or performs a movement control on the basis of the information.

According to this configuration, the life of the magnetic sensor 152 can be prolonged, and the cost can be reduced.

Figure 16:
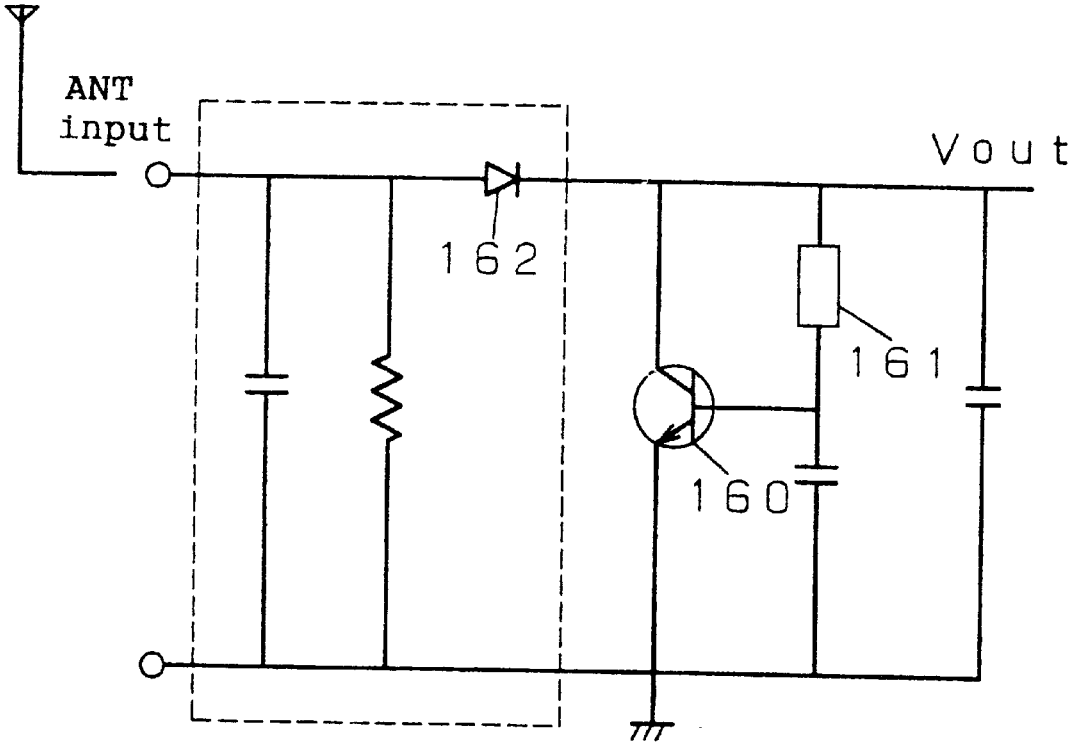
FIG. 16 is a circuit diagram showing an example of a circuit of a magnetic sensor in the mobile unit support system of the eighth embodiment.

FIG. 16 shows an example of the circuit of the magnetic sensor of the embodiment of FIG. 15. As shown in the figure, a stabilized Colpitts oscillating circuit which uses a single transistor 160 and which is operated by a DC power source is employed as a self-oscillating circuit, and an MI element 161 is connected between the base and the collector of the transistor 160. As the DC voltage source, a rectifying circuit using a diode 162 is used. The radio wave from the radio wave generating means is received and an AC carrier current is supplied from the radio wave energy.

According to this configuration, the life of the magnetic sensor can be prolonged, and the cost can be reduced.

Figure 17:
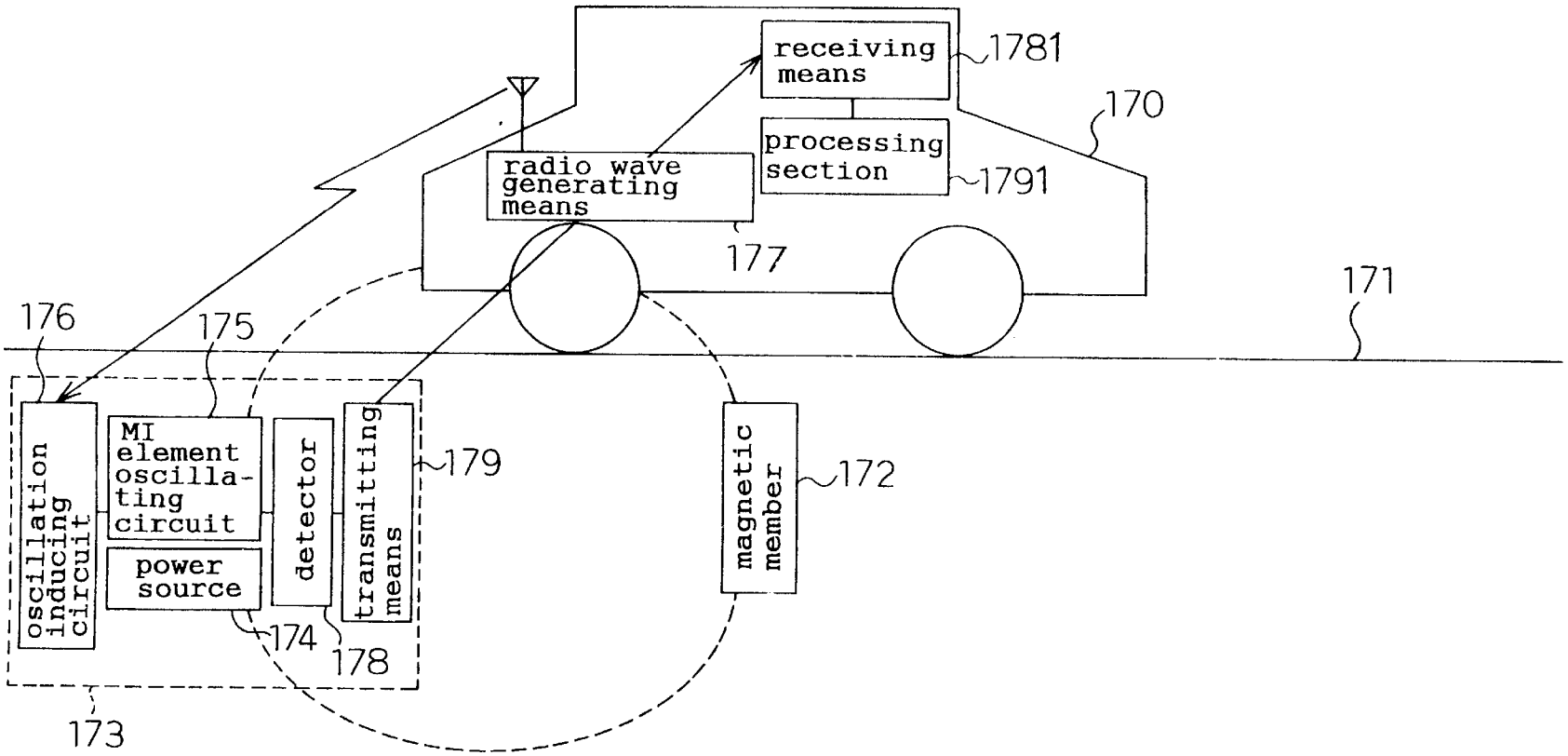
FIG. 17 is a diagrammatic configuration view showing an example of a mobile unit support system of a ninth embodiment of the invention.

FIG. 17 is a diagrammatic configuration view showing an example of a mobile unit support system of a ninth embodiment of the invention. In the mobile unit support system of this embodiment, a magnetic member 172 for forming a magnetic field, and a magnetic sensor 173 are placed in the vicinity of a movement path 171 of a mobile unit 170, which has radio wave generating means 177 and which is made of a dielectromagnetic material. The magnetic sensor 173 comprises an MI element self-oscillating circuit 175, a power source 174, an oscillation inducing circuit 176, a detector 178, and a transmitting means 179. The mobile unit 170 has a configuration which comprises receiving means 1781 and a processing section 1791. As shown in the figure, for example, a magnetic member 172 for forming a magnetic field, and a magnetic sensor 173 are placed in the vicinity of a movement path 171 of a mobile unit 170 (wherein the mobile unit 170 is made of a dielectromagnetic material). In the magnetic sensor 173, a power source 174 supplies a current to an MI element self-oscillating circuit 175. When a mobile unit 170 is not present, an oscillation inducing circuit 176 sets the MI element self-oscillating circuit 175 to be in an oscillation induced state, and, when a mobile unit 170 approaches the magnetic sensor 173, the circuit 176 receives a radio wave from radio wave generating means 177 and causes the MI element self-oscillating circuit 175 to oscillate, by using the radio wave. The electrical properties of the output of the MI element self-oscillating circuit 175 are changed by the passage of the mobile unit 170. A detector 178 detects the change and produces a detection signal. Transmitting means 179 transmits the detection signal to the mobile unit 170.

According to this configuration, the life of the magnetic sensor 173 can be prolonged, and the cost can be reduced.

Figure 18:
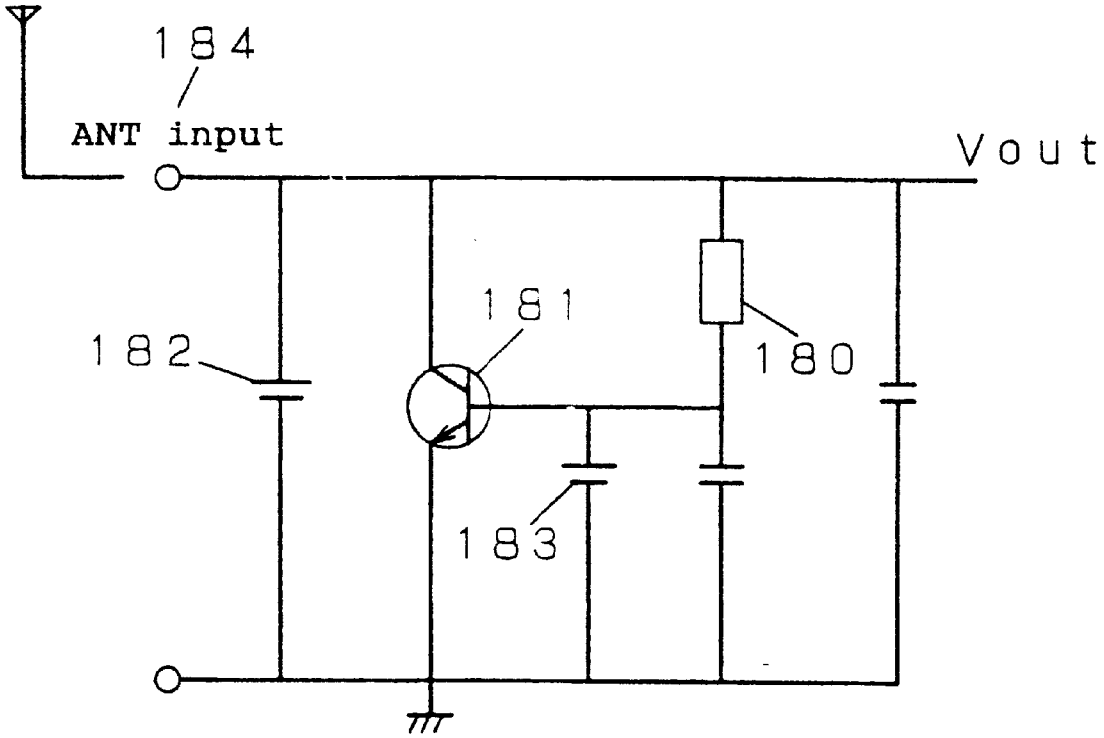
FIG. 18 is a circuit diagram showing an example of an MI element self-oscillating circuit, an oscillation inducing circuit, and a power source of the magnetic sensor of the ninth embodiment.

FIG. 18 shows an example of the MI element self-oscillating circuit, the oscillation inducing circuit, and the power source of the magnetic sensor of the embodiment described above. As shown in the figure, the magnetic sensor is configured by: a Colpitts oscillating circuit which serves as the MI element self-oscillating circuit, which uses an MI element 180 and a transistor 181, and which is operated by a DC current; a power source 182 which supplies a current to the oscillating circuit; an internal excitation power source 183 which serves as the oscillation inducing circuit, and which applies a predetermined voltage between the base and the emitter of the transistor 181 so that the oscillating circuit enters the oscillation excitation state; and an antenna input 184 which, when a mobile unit approaches the magnetic sensor, changes the voltage of the internal excitation power source so that the oscillating circuit enters the oscillation state, in response to an input of a radio wave from the radio wave generating means on the mobile unit.

According to this configuration, the life of the magnetic sensor can be prolonged, and the cost can be reduced.

Figure 19:
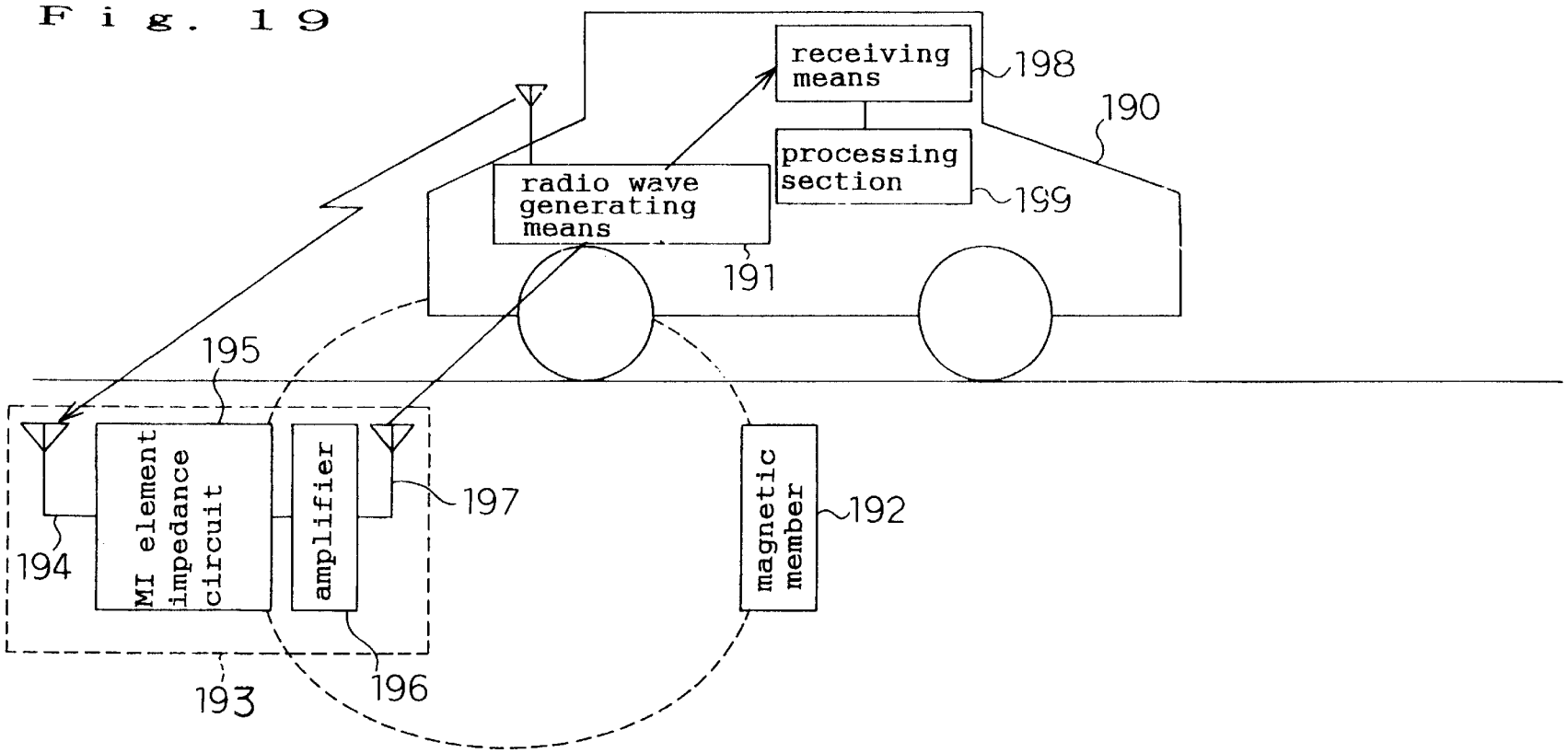
FIG. 19 is a diagrammatic configuration view showing an example of a mobile unit support system of a tenth embodiment of the invention.

FIG. 19 is a diagrammatic configuration view showing an example of a mobile unit support system of a tenth embodiment of the invention. In the mobile unit support system of this embodiment, a magnetic member 192 for forming a magnetic field, and a magnetic sensor 193 are placed in the vicinity of a movement path of a mobile unit 190, and the mobile unit 190 has radio wave generating means 191 and is made of a dielectromagnetic material. The magnetic sensor 193 is configured by a receiving antenna 194, an MI element impedance circuit 195, an amplifier 196, and a transmitting antenna 197. The mobile unit 190 has a configuration which comprises a receiving means 198 and a processing section 199. As shown in the figure, for example, a magnetic member 192 for forming a magnetic field, and a magnetic sensor 193 are placed in the vicinity of a movement path of a mobile unit 190, wherein the mobile unit 190 is made of a dielectromagnetic material. The receiving antenna 194 of the magnetic sensor 193 receives a radio wave from radio wave generating means 191 of the mobile unit 190 and supplies a high-frequency signal to the MI element impedance circuit 195. The MI element impedance circuit 195 produces an output in which, with respect to the input of the high-frequency signal from the receiving antenna 194, the frequency or the amplitude is changed by a change of the impedance of the MI element caused by a variation of the magnetic field when the mobile unit 190 approaches the magnetic sensor 193. The amplifier 196 amplifies the output signal from the MI element impedance circuit 195, and the transmitting antenna 197 transmits a signal from the amplifier back to the vehicle. In the mobile unit 190, the receiving means 198 receives the signal, and the processing section 199 processes the signal from the receiving means 198, and informs the driver of the mobile unit 190 of the obtained information, or performs a movement control on the basis of the information. Movement information of the mobile unit 190 can be detected with high sensitivity on the basis of deviation between the input and the output of the MI element impedance circuit 195, and the deviation can contain positional information. The movement of the mobile unit 190 can be highly supported based on the information.

As apparent from the above description, according to the invention, a magnetic member for forming a magnetic field in the vicinity of a movement path of a mobile unit or in the mobile unit, and a magnetic sensor having a transmission section which transmits a detected signal are disposed in the vicinity of the movement path of the mobile unit, or a magnetic sensor due to an oscillation circuit using an MI element which is highly responsive to a minute magnetic field is employed as a magnetic sensor, thereby attaining an advantage in that movement information of a mobile unit is detected with high sensitivity, and the movement information is transmitted so as to highly support the movement of the mobile unit.

What is claimed is:

1. A mobile unit support system comprising at least one magnetic sensor including an impedance circuit employing a magnetic impedance element having an impedance that is changed by a variation of a surrounding magnetic field, a power source which supplies a current to the impedance circuit, a detector which detects a change in an output of the impedance circuit caused by a change of impedance of the magnetic impedance element; and a transmitter for transmitting a signal indicating detection of a change in the output of the impedance circuit caused by a change of impedance of the magnetic impedance element; and at least one mobile unit having:

a plurality of magnetic members arranged in a substantially linear manner, polarities of the plurality of magnetic members being alternately inverted on a side of the at least one mobile unit facing the impedance circuit, a receiver for receiving signals transmitted by the transmitter of the at least one magnetic sensor, and a processor which processes signals received by the receiver and informs a driver of the at least one mobile unit of information obtained by processing the signals received by the receiver, or which processes signals received by the receiver and controls movement of the at least one mobile unit on the basis of the processing, wherein a number of the plurality of magnetic members disposed in the at least one mobile unit corresponds to one of a length of the at least one mobile unit, a weight of the at least one mobile unit, and a width of the at least one mobile unit.

2. A mobile unit support system, comprising:

at least one mobile unit formed with a dielectromagnetic material and having a radio wave generator;

a magnetic member for forming a magnetic field in a vicinity of a movement path of the at least one mobile unit; and at least one oscillation magnetic sensor separated from the magnetic member by a predetermined distance, the magnetic sensor including:

a Colpitts oscillating circuit which includes at least one magnetic impedance element having an impedance that is changed by a variation of the magnetic field when the at least one mobile unit moves through the magnetic field, and a transistor and which is operated by a DC current, whereby an oscillation frequency of the Colpitts oscillating circuit changes when the impedance of the magnetic impedance element changes, an external power source which produces a DC voltage by performing diode detection on a radio wave transmitted from the radio wave generator of the at least one mobile unit when the at least one mobile unit approaches, and supplies the DC voltage to a point between a collector and a ground of the transistor to thereby cause the Colpitts oscillating circuit to oscillate when the at least one mobile unit approaches, an oscillation voltage detector that detects a change in the oscillation frequency of the Colpitts oscillating circuit, and a transmitter that transmits a signal when the oscillation voltage detector detects a change in the oscillation frequency of the Colpitts oscillating circuit.

3. A mobile unit support system, comprising:

at least one mobile unit formed with a dielectromagnetic material and having a radio wave generator;

a magnetic member for forming a magnetic field in a vicinity of a movement path of the at least one mobile unit; and at least one magnetic sensor separated from the magnetic member by a predetermined distance, the magnetic sensor including:

a Colpitts oscillating circuit having:

at least one magnetic impedance element having an impedance that is changed by a variation of the magnetic field when the at least one mobile unit moves through the magnetic field, and a transistor and which is operated by a DC current, whereby an output oscillation frequency and amplitude of the Colpitts oscillating circuit changes when the impedance of the magnetic impedance element changes, an internal excitation power source which applies a predetermined voltage between a base and an emitter of the transistor so that the Colpitts oscillating circuit enters an oscillation excitation state;

an antenna that, in response to an input of a radio wave from said radio wave generator when the at least one mobile unit approaches, causes the internal excitation power source to apply the predetermined voltage so that the Colpitts oscillating circuit enters the oscillation state;

an oscillation voltage detector that detects a change of an oscillation voltage output of the Colpitts oscillating circuit, and a transmitter for transmits a signal indicating detection of a change in the oscillation voltage output of the Colpitts oscillating circuit.

4. A mobile unit support system, comprising:

at least one oscillation sensor disposed in a vicinity of a movement path of a mobile unit, the at least one oscillation sensor including:

a receiving antenna for receiving radio waves and producing a high-frequency signal in response thereto, an impedance circuit employing an input for receiving the high-frequency signal from the receiving antenna, a magnetic impedance element having an impedance that is changed by a variation of a surrounding magnetic field, and an output for providing an output signal, the impedance circuit changing the high-frequency signal present at the input from the receiving antenna according to variations in the surrounding magnetic field to provide an output signal, an amplifier for amplifying the output signal from the impedance circuit, and a transmitting antenna for transmitting the amplified output signal from the amplifier; and at least one mobile unit including:

a radio wave generator, a receiver for receiving a signal from the transmitting antenna, and a processor which processes signals received by the receiver and informs a driver of the at least one mobile unit of information obtained by processing the signals received by the receiver, or which processes signals received by the receiver and controls movement of the at least one mobile unit on the basis of the processing.

* * * * *